US010704352B2

(12) United States Patent
Lycke et al.

(10) Patent No.: US 10,704,352 B2
(45) Date of Patent: Jul. 7, 2020

(54) SAFETY SYSTEM FOR OVERRIDING HYDROCARBON CONTROL MODULE

(71) Applicant: AKER SOLUTIONS AS, Lysaker (NO)

(72) Inventors: Ellen Merete Strømmen Lycke, Bekkestua (NO); Rune Ove Jensen, Lier (NO); Svein Larsen, Revetal (NO); Jon Lund-Larsen, Asker (NO)

(73) Assignee: AKER SOLUTIONS AS, Lysaker (NO)

( * ) Notice: Subject to any disclaimer, the term of this patent is extended or adjusted under 35 U.S.C. 154(b) by 0 days.

(21) Appl. No.: 15/781,511

(22) PCT Filed: Dec. 8, 2016

(86) PCT No.: PCT/EP2016/080351
§ 371 (c)(1),
(2) Date: Jun. 5, 2018

(87) PCT Pub. No.: WO2017/097945
PCT Pub. Date: Jun. 15, 2017

(65) Prior Publication Data

US 2018/0274319 A1 Sep. 27, 2018

(30) Foreign Application Priority Data

Dec. 8, 2015 (GB) ..... 1521605.4
Dec. 8, 2015 (NO) ..... 20151677

(51) Int. Cl.
*E21B 33/035* (2006.01)
*E21B 44/00* (2006.01)
(Continued)

(52) U.S. Cl.
CPC ..... *E21B 33/0355* (2013.01); *E21B 34/16* (2013.01); *E21B 44/00* (2013.01); *F15B 20/005* (2013.01)

(58) Field of Classification Search
CPC ..... E21B 33/0355; E21B 34/16; E21B 44/00; F15B 20/005
See application file for complete search history.

(56) References Cited

U.S. PATENT DOCUMENTS 4,052,703 A * 10/1977 Collins, Sr. ..... E21B 33/0355 166/351
4,174,000 A * 11/1979 Milberger ..... E21B 33/0355 137/236.1

(Continued)

FOREIGN PATENT DOCUMENTS

FR 2574849 6/1986
WO 2011041550 4/2011

(Continued)

OTHER PUBLICATIONS

International Search Report for PCT/EP2016/080351, dated May 5, 2017.

*Primary Examiner* — James G Sayre
(74) *Attorney, Agent, or Firm* — Hogan Lovells US LLP

(57) ABSTRACT

Example embodiments presented herein are directed towards a safety system, for example a subsea workover safety system, for overriding a control module configured to actuate a component of a hydrocarbon production apparatus, particularly an apparatus comprising at least one of a lower riser package and an emergency disconnect package.

35 Claims, 18 Drawing Sheets

(51) Int. Cl.
*E21B 34/16* (2006.01)
*F15B 20/00* (2006.01)

(56) References Cited

U.S. PATENT DOCUMENTS

| | | | |
|---|---|---|---|
| 4,662,603 | A | 5/1987 | Etheridge |
| 2005/0121188 | A1 | 6/2005 | Douglas et al. |
| 2008/0156077 | A1 | 7/2008 | Flanders |
| 2014/0102712 | A1 | 4/2014 | Gutierrez et al. |
| 2014/0144515 | A1 | 5/2014 | Kent et al. |
| 2014/0374114 | A1 | 12/2014 | Brock et al. |

FOREIGN PATENT DOCUMENTS

| | | | | |
|---|---|---|---|---|
| WO | 2011094084 | | 8/2011 | |
| WO | WO-2011094084 | A2 * | 8/2011 | ..... E21B 34/066 |
| WO | 2015028651 | | 3/2015 | |
| WO | 2015104173 | | 7/2015 | |

* cited by examiner

SAFETY SYSTEM FOR OVERRIDING HYDROCARBON CONTROL MODULE

CROSS REFERENCE TO RELATED APPLICATIONS

This application is a 35 U.S.C. 371 National Stage of International Application No. PCT/EP2016/080351, titled "SAFETY SYSTEM FOR OVERRIDING HYDROCARBON CONTROL MODULE", filed Dec. 8, 2016, which claims priority to GB Application No. 1521605.4, titled "WORKOVER SAFETY SYSTEM", filed Dec. 8, 2015, and NO Application No. 20151677, titled "WORKOVER SAFETY SYSTEM", filed Dec. 8, 2015, all of which are incorporated by reference herein in their entirety.

Example embodiments presented herein are directed towards a safety system, for example a subsea workover safety system, for overriding a control module configured to actuate a component of a hydrocarbon production apparatus, particularly an apparatus comprising at least one of a lower riser package and an emergency disconnect package.

BACKGROUND

A subsea intervention operation on a hydrocarbon comprising well typically includes:

Well Control Package ("WCP")—typically comprising two subsea modules, Emergency Disconnect Package ("EDP") and Lower Riser Package ("LRP"), typically surrounding the well bore with safety valves, Riser System—a set of connected riser joints, typically pipes with approximate lengths 30-50 m, which connect the WCP and Workover rig or vessel, Workover Control System ("WOCS")—typically comprising electric, electronic and hydraulic systems that control practically all operations in WOS, said operations include, opening and closing of valves, measuring of parameters including, temperature and pressure, energy supply to various equipment including, electric and hydraulic.

Nowadays there are increased requirements for the Safety Instrumented Systems ("SISs"), for example, the Norwegian Petroleum Authority requires stringent implementation of SISs to mitigate risks to personnel, environment and assets. In the Workover business segment, this mainly relates to three safety functions, Production Shutdown ("PSD"), Emergency Shutdown ("ESD"), and Emergency Quick Disconnect ("EQD").

The above functions strive to protect the rig or vessel from hazardous conditions such as hydrocarbon spill or leakage in the process area or environment, and spill from the riser. These functions further protect the integrity of the well, for example in the event of position loss. Position loss may occur for example, if the vessel/rig drifts outside a given area from the location of the well.

Implementation of the minimum scope of the safety functions is usually regulated through international standards such as IEC61508 and ISO 13628-7, where the latter also includes some Workover specific requirements.

U.S. Pat. No. 4,174,000 describes a method and apparatus for interfacing a plurality of control systems for a subsea well.

US2005/0121188A1 describes controlling a fluid well.

WO2011/041550A2 describes a subsea control system with interchangeable mandrel.

US2014/0374114A1 describes a subsea intervention system.

BRIEF SUMMARY

In conventional systems, the safety functions are implemented as an integral part of the process control system, wherein some sort of software separation is implemented between the process control system and the SIS. Some safety regulations demand further separation of the Workover Safety System ("WSS") from the process control system, such that the WSS is segregated from the process control system.

To summarize, some of the example embodiments presented herein are directed towards a system used for controlling a subsea intervention operations arrangement, said arrangement may handle hydrocarbons from a subsea well. Said system comprises a first controller adapted for controlling functions such as, opening and closing of various valves in said subsea intervention operations arrangement. Said first controller can also be adapted to measure process parameters such as temperature and pressure at various points within said subsea intervention operations arrangement. Said first controller can also be adapted to control energy supply to various equipment and valves in said subsea intervention operations arrangement. Said valves and said various equipment are operated electrically, hydraulically, pneumatically, or such, alone or in combination. Said system further comprises a second controller adapted to be physically separated in terms of hardware from the first controller. By physically separated it is meant that the first controller and the second controller are realized as two different entities, for example as two different electronic modules. According to some of the example embodiments, at least one of the first controller, and the second controller are realized as logic controllers such as Programmable Logic Controllers ("PLCs"). Said second controller is capable of executing safety functions in said subsea intervention operations arrangement by operating at least some of said various equipment and valves independent of said first controller.

Some of the example embodiments presented herein are directed towards a system and method for implementation of a Workover Safety System ("WSS"), wherein said WSS is physically segregated from the process control system ("WOCS") 100. The WSS as proposed in the some of the example embodiments is designed to be simplistic in sense, only implementing the absolute necessary functionality to achieve shutdown and/or disconnect. In addition, some of the example embodiments seek to reduce the response times for critical events, for example, subsea safety functions ESD and EQD. The system is designed with features including reduced number of critical valves for ESD/EQD, implementing bleed-off function, and eliminating the need for WOCM 104 in shutdown events. The safety system according to some of the example embodiments is designed to override any action taken by the Workover Control System. When a safety event occurs, the safety system is capable of overriding any commands by the WCS.

Some of the example embodiments will now be described in detail below with reference to accompanying drawings, illustrating the example embodiments by way of examples.

For the sake of simplicity without limitation or loss of generality, most of the discussion in this specification will use an open-water workover system to describe some of the example embodiments. A person skilled in the art will understand that the features of some of the example embodiments can be applied to other types of workover, subsea, or other systems where advantages such as an enhanced separation and reliability between the control system and the safety system are required.

Furthermore, for the sake of simplicity, functionality lying within the scope of the same sub-system, for example, blocks representing a WSS function are typically shown with the same reference sign on all the figures. A person skilled in the art will understand that such WSS shown in different figures does not have to be the exact same module or controller comprising entire functionality shown in all of the attached figures, it may also be a different controller implemented in a distributed control topology or their like. Such distributed controllers, might be communicating with each other, and/or to a main controller by using a communication link. Such variations in implementation have not been shown in the following figures to keep the matter simple, so their absence should not been deemed limiting or seen as a loss of generality of some of the example embodiments. Similar reasoning also applies to other blocks presented in the following figures.

Accordingly, some of the example embodiments are directed towards a workover safety system for overriding a workover control module configured to actuate a component of a hydrocarbon production apparatus, particularly an apparatus comprising at least one of a lower riser package and an emergency disconnect package. The workover control module is configured to regulate hydraulic fluid to the component. Various embodiments may be implemented with a blowout preventer, a drilling package, a Christmas tree (e.g., an electrically actuated tree), a riser package, and the like.

The workover control module comprises a power input, such as a hydraulic input configured to receive the hydraulic fluid from a corresponding hydraulic fluid source and a hydraulic output configured to deliver the received hydraulic fluid to the component.

The workover safety system comprises a trigger input configured to receive a trigger signal, and may include at least one pressure valve configured to be in connection between a hydraulic output and a safety accumulator. The at least one pressure valve is configured to receive accumulated hydraulic fluid from the safety accumulator. The safety system may be configured to close, particularly close a functional line and open a vent line, the at least one override valve upon receipt of the trigger signal to prevent the hydraulic fluid being delivered to the component.

Some example embodiments are directed towards a safety system configured to be coupled to a hydrocarbon processing arrangement to bring at least a part of the arrangement to a safe state, which may include overriding the control module. The arrangement comprises a control module, particularly at least one of a Workover Control Module (WOCM), a Subsea Electronics Module (SEM), Subsea Control Module (SCM) and a Riser Control Module (RCM).

The control module may be configured to actuate a component of the arrangement, particularly a component comprising at least one of a topside production facility, a Lower Riser Package (LRP), an Emergency Disconnect Package (EDP), a Blowout Preventer (BOP), a Riser Package (RP), a Drilling Package (DP), a Master Control Unit (MCU), and a Hydraulic Power Unit (HPU), a Christmas tree, particularly a surface tree, particularly a subsea tree, particularly a Christmas tree having an electrically actuated valve, a manifold, a coiled tubing frame, and a wireline frame.

The control module comprises an energy input, particularly at least one of an electrical input, pneumatic input, and a hydraulic input, the energy input configured to receive a power flow from a corresponding power source sufficient to actuate the component, particularly an electric actuator, particularly at least one of a screw drive and a solenoid, particularly a hydraulic actuator, particularly to a pneumatic actuator. The control module further comprises an energy output, particularly at least one of a hydraulic output, pneumatic output, and an electrical output, configured to deliver the power flow, regulated via the control module, to the component.

The safety system comprises a control input configured to receive a trigger signal. The safety system further may comprise at least one override gate, particularly at least one of a valve and a switch, particularly a relay, in a series connection between the energy input of the control module and the corresponding power source providing power to the control module; and/or the energy output of the control module and the component. The safety system may be configured to close the at least one override gate upon receipt of the trigger signal to prevent the power flow from being delivered to the component.

According to some of the example embodiments, the systems described above may further comprise a safety accumulator coupled to at least one pressure and/or accumulator gate, which may be configured to be coupled in a parallel connection with an energy output of the control module to deliver power to the component. The pressure gate may comprise a valve or relay. The at least one pressure gate may be configured to receive a power flow from the, wherein upon receipt of the trigger signal, the at least one pressure gate is configured to be in an open position and provide said power flow to the at least one gate disposed in an Emergency Disconnect Package, EDP, a valve in a Riser Control Module, RCM, and/or an annular bag disposed within a Blowout Preventer, BOP, to provide a hydraulic pressure, independently of the control module, to the EDP and/or BOP, respectively.

Some of the example embodiments are directed towards a workover safety system for a workover control module configured to actuate a component of a hydrocarbon production apparatus, particularly an apparatus comprising at least one of a lower riser package and an emergency disconnect package. The workover control module may be configured to regulate hydraulic fluid to the component. In some cases, a safety system may actuate the component despite an attempt by the control module not to actuate the component.

The workover control module may comprise a hydraulic input configured to receive the hydraulic fluid from a corresponding hydraulic fluid source and at least one hydraulic output configured to deliver the received hydraulic fluid to the component.

The workover safety system comprises a trigger input configured to receive a trigger signal. The workover safety system also may comprise at least one pressure valve in a parallel connection with a hydraulic output, the at least one pressure valve is configured to receive accumulated hydraulic fluid from a fail-safe accumulator. The safety system is configured to open the at least one pressure valve upon receipt of the trigger signal to deliver accumulated hydraulic fluid to the component.

Some of the example embodiments are directed towards a safety system configured to be coupled to a hydrocarbon processing arrangement to bring at least a part of the arrangement to a safe state. The arrangement comprising a control module, particularly at least one of a Workover Control Module (WOCM), a Subsea Electronics Module (SEM), Subsea Control Module (SCM) and an Riser Control Module (RCM).

The control module may be configured to actuate a component of the arrangement, particularly a component comprising at least one of a topside production facility, a Lower Riser Package (LRP), an Emergency Disconnect Package (EDP), a Blowout Preventer (BOP), a Riser Package (RP), a Drilling Package (DP), a Master Control Unit (MCU), and a Hydraulic Power Unit (HPU), a Christmas tree, particularly a surface tree, particularly a subsea tree, particularly a Christmas tree having an electrically actuated valve, a manifold, a coiled tubing frame, and a wireline frame The control module comprises an energy input, particularly at least one of an electrical input, a pneumatic input, and a hydraulic input, the energy input configured to receive a power flow from a corresponding power source sufficient to actuate the component, particularly an electric actuator, particularly at least one of a screw drive and a solenoid, particularly a hydraulic actuator, a pneumatic actuator; and an energy output, particularly at least one of a hydraulic output and an electrical output, configured to deliver the power flow, regulated via the control module, to the component.

The safety system comprises a control input configured to receive a trigger signal. The safety system further comprises a safety accumulator, particularly at least one of a hydraulic accumulator, a battery, a capacitor, a flywheel, and a UPS, configured to store energy, and at least one accumulator gate, particularly at least one of a valve and a relay, configured to be disposed in a parallel connection with at least one of: the energy input of the control module and the corresponding power source; and the energy output of the control module and the component. The safety system is configured to open the at least one accumulator gate upon receipt of the trigger signal to deliver the stored energy to the component.

According to some of the example embodiments, various systems may further comprise further comprising at least one override gate in a series connection between at least one of: the energy input and the corresponding energy source of the control module, and an energy output of the control module and the component. The safety system is configured to close the at least one override gate upon receipt of the trigger signal to prevent the power flow being delivered to the component.

Some of the example embodiments may be directed towards a power management system comprising a trigger input. The system further comprises a logic device comprising a processor, memory, and instructions stored in the memory and executable by the processor. The logic device coupled to the trigger input, the logic device configured to be coupled to an umbilical including a power line, particularly an umbilical having a length greater than 300 meters, particularly greater than 1000 meters, including greater than 3000 meters. The system may also comprises at least one gate (e.g., a valve) connected to the power line, particularly at least one of an override valve and an accumulator valve.

The system further may comprise a power supply coupled to the logic device, particularly a DC power supply, particularly configured to deliver at least 30 volts, particularly up to about 500 volts. An embodiment may comprise a discrete power supply separate from the logic device. An embodiment may comprise a power supply integrated with the logic device. The power supply may be configured to actuate the valve via the power line when connected to the valve. The system may also comprise a switch, particularly a relay, coupled to the logic device and power supply, the switch operable by the logic device to switch between: a monitoring condition, in which the power supply is not connected to the valve, and an override condition, in which the power supply is connected to the valve. Typically, an umbilical circuit has a substantial (and often varying resistance). As such, assurance that the actual actuation voltage needed to actuate the valve may benefit from monitoring the umbilical circuit.

The logic device configured to perform a method comprising measuring a parameter characterizing an electrical circuit including the power line and valve; calculating a topside voltage expected to result in a desired voltage at the valve when delivered via the umbilical, the desired voltage sufficient to actuate the valve; and transmitting the calculated topside voltage to the power supply. The power supply may be maintained at a topside voltage that is sufficient to actuate the valve, notwithstanding the voltage loss incurred over the umbilical.

According to some of the example embodiments the power management system may further measure via applying a non-actuating voltage to the power line; measuring a current resulting from the applied voltage; normalizing the measured current to a resistance of the valve, particularly subtracting a resistance of the valve; and calculating a resistance of the umbilical using the normalized current.

According to some of the example embodiments, the logic device is further configured to receive a trigger signal via the trigger input (112); and operate the switch to change from the monitoring condition to the override condition to actuate the valve using the power supply.

According to some of the example embodiments, the embodiments described above may comprise a safety system which is separated from the workover control module with respect to software and hardware.

According to some of the example embodiments, wherein the at least one override valve comprises a first override valve in series connection between a first corresponding hydraulic fluid source and a first corresponding hydraulic input, a second override valve in series connection between a second corresponding hydraulic fluid source and a second corresponding hydraulic input, and a least a third override valve in series connection between the hydraulic output of the workover control module and the component.

According to some of the example embodiments, the at least one override valve is in a series connection between a topside control module valve a pilot valve coupled to a surface production wing valve. Upon receipt of the trigger signal, the at least one override valve is configured to be in a closed position thereby preventing a flow of hydraulic fluid to the pilot valve and the surface production wing valve.

According to some of the example embodiments, valves or gates in the workover safety system may comprise replicate gates and/or valves in an NB redundancy.

According to some of the example embodiments, the trigger signal may comprise an analog voltage, particularly, a Direct Current, DC, particularly up to 48V, including up to 25V.

According to some of the example embodiments, the safety system may further comprise a power management system as described above. According to some of the example embodiments, the safety system may further comprise the control module coupled to the safety system.

By independent of said first controller it is meant that the second controller is capable of functions such as, bypassing, taking over the functionality of, ignoring the commands from, said first controller. The second controller uses said functions for bringing at least some of the said various equipment and valves to a safe state.

The first controller is may be a process controller. The second controller is may be a safety controller.

According to some example embodiments, the second controller is adapted to override at least some of the commands of the first controller. The second controller is capable of bringing the system to a safe state. According to some of the example embodiments, the second controller brings the system to a safe state by bringing at least some of the said various equipment to a safe state.

Said subsea intervention operations arrangement may further include topside and associated functionality located elsewhere, besides the subsea located equipment.

Said first controller may either be realized as a single electronic module or as a distributed arrangement comprising a plurality of modules. In another embodiment, said plurality of modules are communicating with each other over a communications medium such as a bus or a wireless link. In another embodiment, the first controller is implemented in a redundancy configuration in the sense that the first controller comprises a first plurality of controllers wherein at least one controller in the redundancy configuration can act as a backup controller even if at least one of the controllers from said first plurality of controllers fails, as long as there is at least one controller within said first plurality that is operational and capable of handling the operations of the first controller.

Also, said second controller may either be realized as a single electronic module or as a distributed arrangement comprising a plurality of modules. In another embodiment, said plurality of modules are communicating with each other over a communications medium such as a bus or a wireless link. In another embodiment, the second controller can also be implemented in a redundancy configuration in the sense that the second controller comprises a second plurality of controllers wherein at least one controller in the redundancy configuration can act as a backup controller even if at least one of the controllers from said second plurality of controllers fails, as long as there is at least one controller within said second plurality that is operational and capable of handling the operations of the second controller.

According to some of the example embodiments, said second controller is capable of communicating with the first controller.

In another embodiment of the system according to some of the example embodiments, said subsea intervention operation comprises a process plant processing hydrocarbons from a subsea well, a Well Control Package ("WCP") may be located subsea, said WCP further comprises an Emergency Disconnect Package ("EDP") and a Lower Riser Package ("LRP"). Said EDP and LRP further comprise a plurality of valves for controlling the flow of said hydrocarbons in said subsea intervention operations arrangement. Said subsea intervention operation also comprises a riser system, a drilling deck, platform or similar, a Master Control Unit ("MCU") may be located on said deck or platform, and a Hydraulic Power Unit ("HPU") may be located on said deck or platform.

In yet another embodiment, said drilling deck or platform is at least partially a watercraft or a part of said watercraft. Said watercraft can be a floating object such as a marine vessel or boat.

In yet another embodiment, said second controller overrides control of a plurality of final elements, said plurality of final elements comprising at least some of the various equipment and valves in the subsea intervention operations arrangement. The second controller overrides control of the plurality of final elements when a safety event is initiated. According to some of the example embodiments, said second controller overrides said control, irrespective of the control commands from said first controller to said plurality of final elements. The second controller overrides control of the plurality of final elements by overriding at least some of the pneumatic and/or hydraulic and/or electric control commands from said first controller to said plurality of final elements. The second controller, hence, is able to achieve prioritized control over said at least some of the various equipment and valves in the subsea intervention operations arrangement.

By override it is meant that the second controller or the safety controller has the highest priority of control over at least some of said various equipment when it comes to the safety functions. The control commands of the first controller or the process controller, hence have a lower priority of control over said at least some of said various equipment. The second controller exercises this priority when a safety event occurs or is triggered.

According to some of the example embodiments, the second controller brings each final element within said plurality of final elements to the respective predetermined safe state of said each final element. By final elements it is meant elements such as, solenoids, valves, regulators, circuit breakers, or relays.

In another embodiment, the second controller overrides control of said plurality of final elements upon detection or initiation of a safety event. Said safety events include Production Shutdown ("PSD"), Emergency Shutdown ("ESD"), or Emergency Quick Disconnect ("EQD").

According to some of the example embodiments, the system further includes a plurality of Uninterruptable Power Supply ("UPS"). Said plurality of UPS are electrically coupled to the first controller to supply electrical power for the execution of control functions of said first controller. At least some portion of said plurality of UPS is also electrically coupled to said second controller. The second controller is adapted to monitor predetermined parameters, including voltage, current, and remaining power or energy within said plurality of UPS. The second controller is further adapted to isolate at least a portion of the various equipment and valves from drawing power from said plurality of UPS under predetermined conditions.

In another embodiment, said predetermined conditions include initiation of a safety event and remaining power or energy in said plurality of UPS below a pre-determined range or limit.

In yet another embodiment, the system further comprises, at least one Control Valve, for example a DCV. Said Control Valve is controlled by said second controller and is adapted to control the flow or pressure in a fluid-carrying supply line. Said fluid-carrying supply line can be a hydraulic supply line, or pneumatic supply line, or similar. Said fluid-carrying supply line is configured to supply power from fluid under pressure within said fluid-carrying supply line. The power, due to pressure of said fluid within said fluid-carrying supply line, is used for operating a plurality of equipment. Said equipment includes final elements such as valves. The second controller includes at least one power supply used by said second controller for controlling said at least one Control Valve. The controller also comprises at least one initiation unit configured for generating a trigger event. Said trigger event notifies the second controller that a specific safety event has initiated. Upon receiving said trigger event, the second controller is configured to send a signal to said at least one Control Valve for adapting the flow or pressure of fluid within said fluid-carrying supply line such that at least some of the equipment within said plurality of equipment is set to a safe state. The system adapts the pressure within said fluid-carrying supply line by for example, bleeding off, blocking, or injecting additional fluid to, the fluid within said fluid-carrying supply line.

According to some of the example embodiments, the system further comprises a power management system, and said power management system comprises at least one electrical cable for electrically coupling a power supply unit to at least one electrical consumer. Said power supply unit can be a high voltage power supply unit. Said power supply unit is used for supplying electrical power into the at least one electrical cable. Said at least one electrical consumer may be located remotely from the location of said power supply unit. Said at least one electrical consumer is adapted to draw electrical power supplied by the power supply unit through said at least one electrical cable. The proposed power management system further comprises a measurement unit adapted to measure electrical parameters including voltage, current and power at predetermined locations on said electrical cable. The location of measurement of electrical parameters may be close to the power supply unit. The system further comprises a configuration unit, said configuration unit comprising at least one switching element, such as relay or high voltage semiconductor. Said at least one switching element may be serially connected between the power supply and the at least one cable. The location of said configuration unit may also be close to the location of the power supply unit. Said configuration unit is adapted to configure parameters of the electrical power supplied by the power supply unit. Said second controller is adapted to communicate with said power supply unit, said configuration unit and said measurement unit, and the second controller is further adapted to dynamically configure the configuration unit such that electrical power received by said at least one electrical consumer is within predetermined limits at all times. Thus, by monitoring said electrical parameters, the proposed power management system is able to configure the power supplied to the said at least one consumer such that the power received by the said at least one consumer is always within favorable limits. The system may be configured to monitor a plurality of consumers individually such that power parameters of each consumer are individually tracked and maintained within desired limits.

Some of the example embodiments comprise an embodiment of a control system for controlling safety functions in a subsea intervention arrangement. Said control system comprises at least one Control Valve ("DCV") adapted to control the flow or pressure of a fluid-carrying supply line. Said fluid-carrying supply line is configured to supply power from fluid under pressure within said fluid-carrying supply line for operating a plurality of equipment. Said equipment include final elements such as valves, at least one logic controller, for example, a Programmable Logic Controller ("PLC"), adapted for controlling said at least one Control Valve. Said control system also comprises at least one power supply used by said at least one logic controller for controlling said at least one Control Valve. The control system also includes at least one initiation unit, such as a pushbutton, configured for generating a trigger event, said trigger event notifies the at least one logic controller that a specific safety event has initiated. Upon receiving said trigger event, the at least one logic controller is configured to send a signal to said at least one Control Valve for adapting the flow or pressure of fluid within said fluid-carrying supply line such that at least some of the equipment within said plurality of equipment is set or brought to a safe state.

According to some of the example embodiments, said fluid-carrying supply line is a hydraulic supply line, or a pneumatic supply line, or their combinations.

In another embodiment, the control system adapts the pressure of said fluid-carrying supply line by bleeding off the pressure within said fluid-carrying supply line.

In yet another embodiment, the control system adapts the pressure of said fluid-carrying supply line by injecting additional fluid within said fluid-carrying supply line.

In yet another embodiment, the control system adapts the pressure of said fluid-carrying supply line by blocking or redirecting fluid within said fluid-carrying supply line.

In another embodiment of said control system, at least one logic controller executes a plurality of safety function steps. Said safety function steps comprise a set of commands executed by said at least one logic controller in a predetermined sequence for controlling at least some of the equipment within said plurality of equipment.

In yet another embodiment of the control system, said at least one power supply also comprises a power source and at least one energy storage unit. Said control system is further adapted to monitor parameters of said power source and said at least one energy storage unit. Said parameters include remaining stored energy within said energy storage unit, forecast of required power or energy for successfully executing remaining safety function steps, and operational parameters of said power source. Under predetermined conditions, the control system is adapted to isolate, trip, or shutdown, any non-critical equipment drawing power from said at least one power supply. The proposed control system, is thus able to reserve remaining power for executing critical functions such as said safety function steps.

In one embodiment, said at least one energy supply is hydraulic, said power source is a hydraulic pump and said at least one energy storage unit is a hydraulic accumulator.

In another embodiment, said at least one energy supply is electric, said power source is a generator or a switchboard and said at least one energy storage unit is a UPS.

In yet another embodiment, said at least one energy supply is pneumatic, said power source is a pump, and said at least one energy storage unit is a pneumatic accumulator.

In another embodiment of the proposed control system, said predetermined conditions include said power source unavailable, and said remaining stored energy below a predetermined limit.

In yet another embodiment, said control system is related to subsea intervention operations including a movable platform, and said initiation unit further comprises a measurement unit for measurement of parameters including the position of said platform. Said initiation unit is adapted to generate a trigger event notifying said logic controller that a safety event has initiated if said parameters drift beyond predetermined limits.

In another embodiment, said control system further comprises a relay to switch in a higher voltage, insulation resistance line monitoring logic, and ohmmeter for line monitoring.

Some of the example embodiments comprise an embodiment of a power management system for application in a subsea intervention arrangement. Said power management system comprises at least one electrical cable for electrically coupling a power supply unit to at least one electrical consumer. Said power supply unit can be a high voltage power supply unit. Said power supply unit is used for supplying electrical power into the at least one electrical cable. The at least one electrical consumer may be located remotely from the location of said power supply unit. The at least one electrical consumer is adapted to draw electrical power supplied by the power supply unit through said at least one electrical cable. The proposed power management system further comprises a measurement unit adapted to measure electrical parameters including voltage, current and power at predetermined locations on said electrical cable. The predetermined location on said electrical cable is close to the location of the power supply unit. The power management system further comprises a configuration unit, said configuration unit also comprising at least one switching element. Possible embodiments of said switching element include relay, and high voltage semiconductor device. Said at least one switching element may be serially connected between the power supply and the at least one cable. The configuration unit may be located close to the power supply unit. Said configuration unit is adapted to configure parameters of the electrical power supplied by the power supply unit into the at least one electrical cable. The power management system also comprises a logic controller, for example, a Programmable Logic Controller ("PLC"). Said logic controller is further adapted to communicate with said power supply unit, said configuration unit and said measurement unit. The logic controller is capable of dynamically configuring the configuration unit such that electrical power received by said at least one electrical consumer is within predetermined limits at all times.

According to some of the example embodiments of the proposed power management system, said logic controller is adapted to control said configuration unit using at least one electrical output. Said electrical output may be digital, but in another embodiment, said electrical output can also be at least partially analog.

According to some of the example embodiments of the power management system, said logic controller is adapted to monitor status and settings of said configuration unit using at least one electrical input. Said electrical input may be digital, but in another embodiment, said electrical input can also be at least partially analog.

In another embodiment of the power management system, said configuration unit is located within said power supply unit.

In another embodiment of the power management system, the logic controller maintains nearly constant current flowing through said at least one electrical cable.

In yet another embodiment of the power management system, the logic controller maintains near constant voltage across said at least one consumer.

In yet another embodiment of the power management system, the parameters of the power received by said at least one consumer are independent of the voltage drop across and resistance variations in the said at least one electrical cable.

According to some of the example embodiments of the power management system, the logic controller is instantiated with an initial model or nominal values of the components within the power management system. Said nominal values and model include, electrical parameters of the cable, physical parameters of the at least one electrical cable, and electrical parameters of the at least one consumer.

In yet another embodiment of the power management system, the logic controller records variations in the said electrical parameters over time and said logic controller is adapted to generate a signal that a specific component within said power management system is probable to fail soon.

BRIEF DESCRIPTION OF THE DRAWINGS

Embodiments of some of the example embodiments are further described hereinafter with reference to the accompanying drawings, in which.

DETAILED DESCRIPTION

Figure 1:
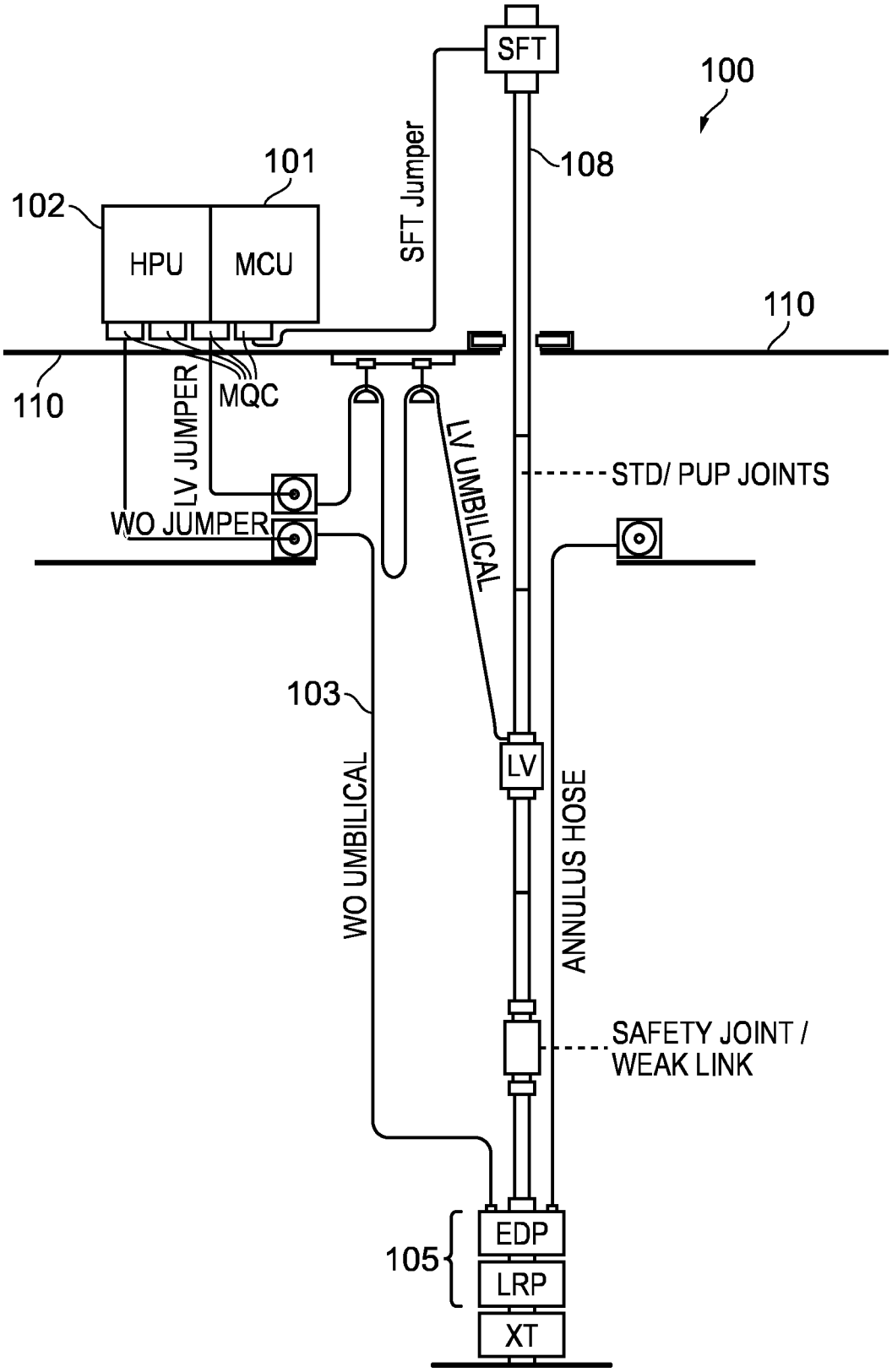
FIG. 1 illustrates a simplified example of a typical conventional workover system.

FIG. 1 shows a simplified example of a riser based conventional Workover Control System ("WOCS") 100. Such a system comprises a riser 108, a Master Control Unit ("MCU") 101 placed, for example, upon a drilling rig deck or platform 110, a Hydraulic Power Unit ("HPU") 102, umbilicals, comprising e.g., workover umbilical 103, Subsea Electronics Module ("SEM") (see for example 201, FIG. 2) and Workover Control Module ("WOCM") typically comprised in WCP 105. Amongst these, The MCU 101 is typically a container located on a deck 110. Said container typically comprises operator control panels, logic controller, subsea power and communications unit, and other electrical, electronic or programmable system components. The MCU communicates with the HPU 102 and one or more Subsea Electronics Modules 201.

The HPU 102 typically comprises accumulators and hydraulic function control valves. The HPU 102 may further comprise pneumatic valves and electrically operated solenoid valves.

The SEM 201 is typically split in one instrument module and one control function module. The control function SEM comprises driver cards that receive signals from the topside control system and applies power to the corresponding hydraulic control function in the Workover Control Module ("WOCM"). WOCM, see e.g., 201 is typically located subsea and is a part of the Well Control Package ("WCP") 105. FIG. 1 also shows a riser system 108.

In other words, the MCU 101 typically sends digital control signals to the HPU 102 and to the WOCM for controlling the operation of the valves in the Workover System. Other parts shown in FIG. 1 are not discussed further as they will be obvious to the person skilled in the art.

Figure 2:
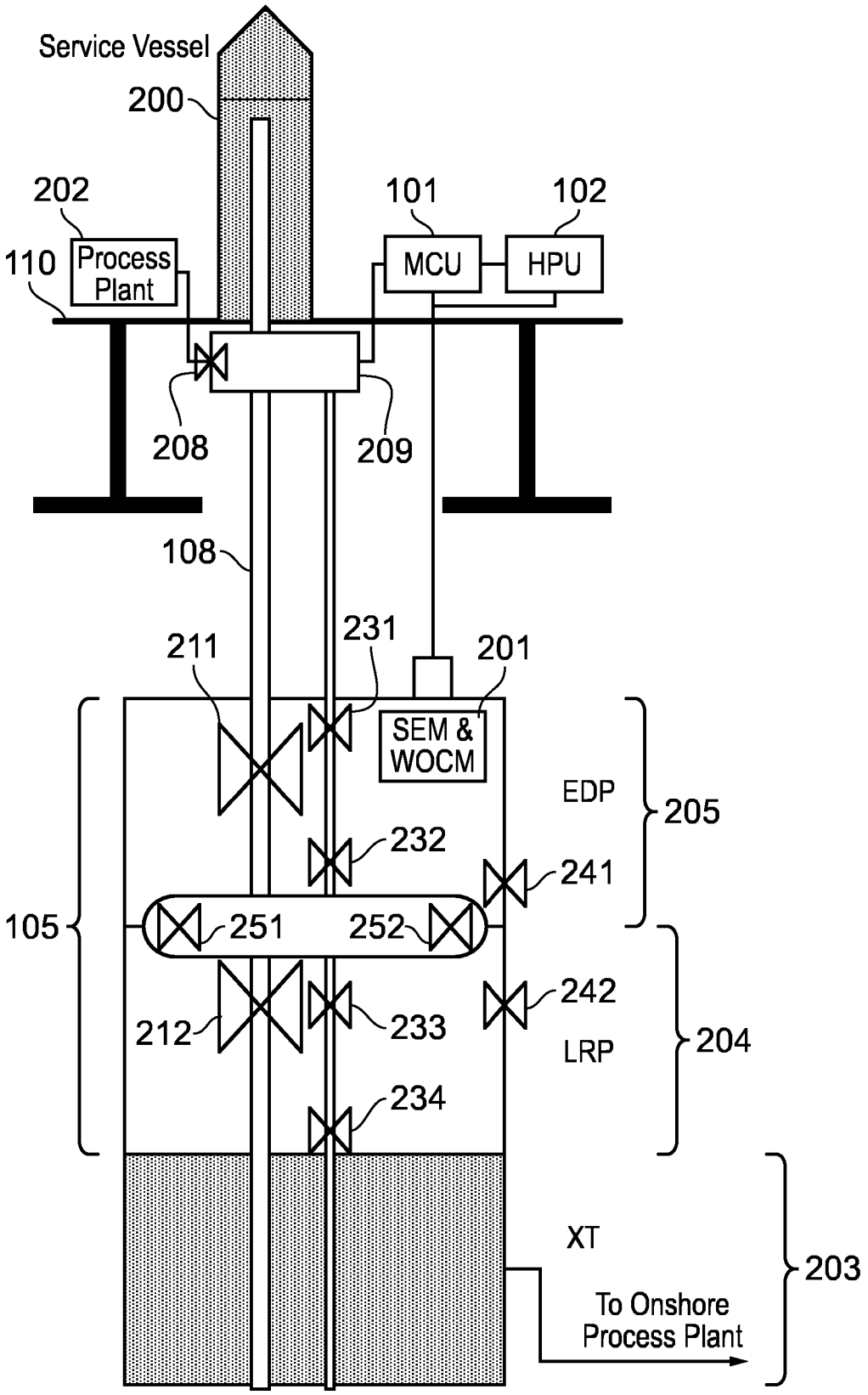
FIG. 2 illustrates an alternative example of a typical conventional workover system.

FIG. 2 shows an alternative diagram of a Workover System. The system comprises 200, a drilling rig derrick, or tower or such for workover, said tower or derrick may for example be aboard a service vessel or rig with a platform or deck 110, and a process plant 202. Said deck 110 may be placed on a drilling rig or it may be placed on a well intervention vessel. On a drilling rig this deck 110 is often named drill floor. On the automation side, the system comprises an MCU 101 and an HPU 102 located on the topside. The figure further shows the Well Control Package ("WCP") 105 in more detail. WCP 105, sometimes also called workover stack, mainly comprises Lower Riser Package ("LRP") 204, and Emergency Disconnect Package ("EDP") 205. Christmas Tree ("XT") 203 is also shown for reference. The LRP 204 and EDP 205 comprise a plurality of valves for controlling and isolating the flow of hydrocarbons. The main functionality of typical valves in the workover system is as follows, Surface Production Wing Valve ("SPWV") 208 is typically located in the surface flow tree 209. SPWV 208 is used for isolating the vessel process plant from hydrocarbon flow in a riser-based workover system.

Gate valve, typically named here Retainer Valve ("RV") 211 is used for isolating the riser 108 from hydrocarbon flow in a riser-based workover system. RV 211 retains potential hydrocarbons inside the riser, for example, in the event of an Emergency Quick Disconnect ("EQD").

Gate valve, typically called here Production Isolation Valve ("PIV") 212 is used for isolating the riser 108 from the hydrocarbon flow in a riser-based workover system. PIV 212 also functions as a secondary well barrier, for example, in the event of an Emergency Quick Disconnect ("EQD").

Valves 231, 232, 233 and 234 illustrate annulus bore valves, crossover valves, and injection valves. These valves are used for functions including, circulating the well and injecting chemicals.

Typically named EDP Sea Dump Valve, 241 is used for opening the return line for the hydraulic control fluid into the sea in order for the return system to not restrict the control fluid flow from the valves, for example, during an event of Emergency Shutdown ("ESD") or Emergency Quick Disconnect ("EQD").

Typically named LRP Sea Dump Valve, 242 is used for opening the return line for the hydraulic control fluid into the sea in order for the return system to not restrict the control fluid flow from the valves, for example, during an event of Emergency Shutdown ("ESD") or Emergency Quick Disconnect ("EQD").

EDP Connector Primary Unlock 251 is used for unlocking the EDP connector, allowing the EDP 205 to disconnect from LRP 204.

EDP Connector Secondary Disconnect 252 is used for backup function to the EDP Connector Primary Unlock 251. The primary function of Secondary Disconnect 252 is to allow the EDP 205 to disconnect from LRP 204.

There are typically two main bore valves in the LRP 204, either two gate valves or (e.g. upper and lower PIV) one gate valve and one shear seal ram (Safety Head ("SH")).

Some of the example embodiments are directed towards a system and method for implementation of a Workover Safety System ("WSS"), wherein said WSS is physically segregated from the process control system ("WOCS") 100. The WSS as proposed in some of the example embodiments is designed to be simplistic in sense, only implementing the absolute necessary functionality to achieve shutdown and/or disconnect. In addition, some of the example embodiments seek to reduce the response times for critical events, for example, subsea safety functions ESD and EQD. The system is designed with features including reduced number of critical valves for ESD/EQD, implementing bleed-off function, and eliminating the need for WOCM 104 in shutdown events. The safety system according to some of the example embodiments is designed to override any action taken by the Workover Control System. When a safety event occurs, the safety system is capable of overriding any commands by the WCS.

Some of the example embodiments are implemented such that it can be retrofitted to any open-water workover system, riser-less workover system and their like. The topside controller and hydraulic safety adapter are compatible to most direct hydraulic in-riser workover systems, or landing string systems.

Figure 3:
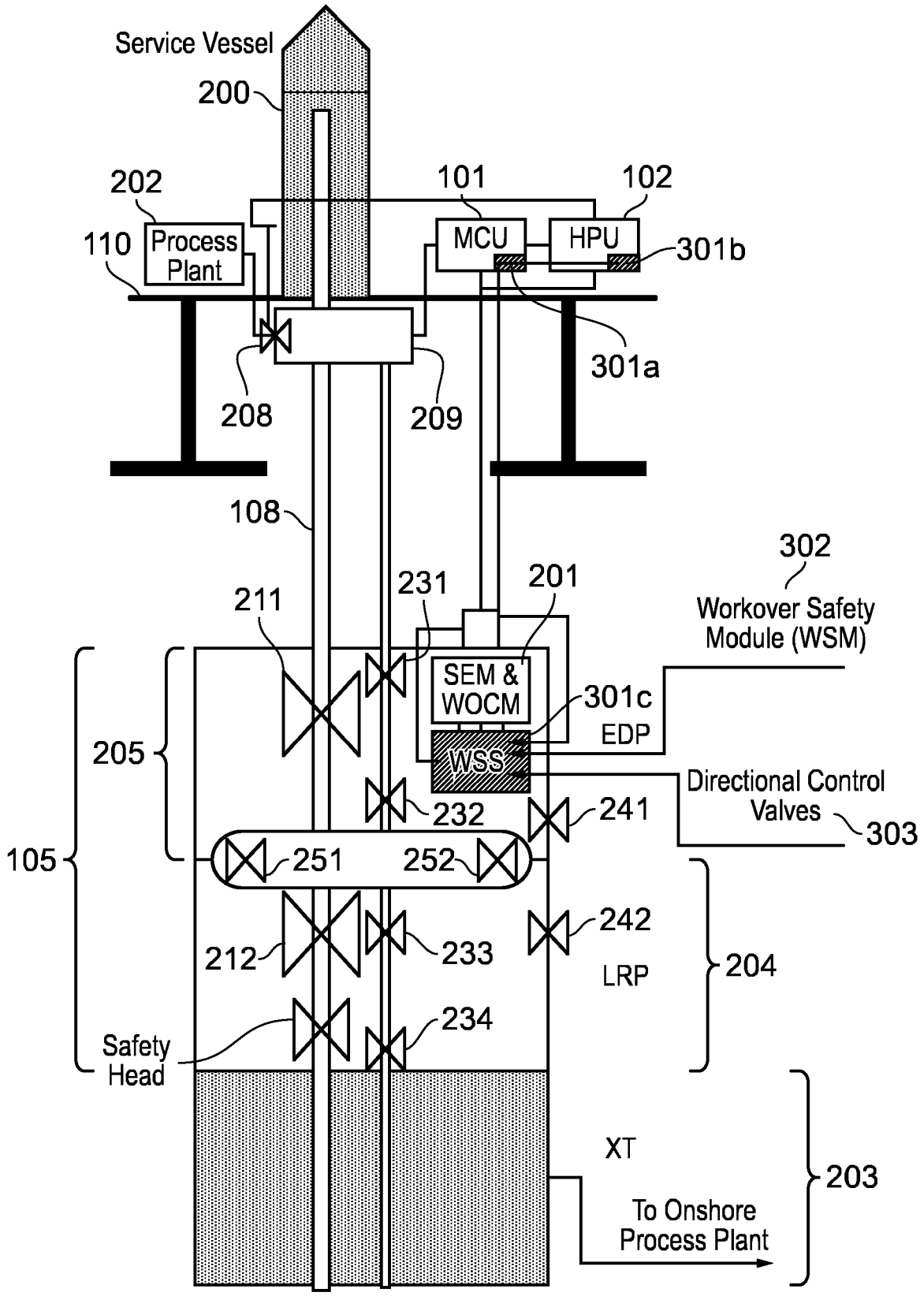
FIG. 3 illustrates an embodiment of the system according to some of the example embodiments.

Now referring to FIG. 3, which illustrates an embodiment of the system shown in FIG. 2 extended with the proposed WSS 301*a*, 301*b* and 301*c*. The proposed WSS 301*a*, 301*a* and 301*c* comprises, Topside part 301*a,b*: Topside part 301*a,b* of the WSS is implemented such that it is independent of the topside part of the WOCS 100. Only exception is an Uninterruptible Power Supply ("UPS") (not shown in FIG. 3), which is shared between the WSS 301*a,b* and WOCS 100. The WSS topside part 301*a* is implemented such that it can be retrofitted into existing workover containers. Alternatively, the WSS topside part 301*a* can be installed in a separate container. The topside part 301*a* of the proposed WSS comprises sequencing logic and communications interfaces as well as the initiators and conditioning monitoring system. In addition, the WSS topside part 301*a,b* includes a Hydraulic Safety Adapter, said adapter further comprising Directional Control Valves for initiation of direct hydraulic safety functions such as Production Shutdown ("PSD") and in-riser workover ESD.

Workover Safety Module ("WSM") 302: In this embodiment, WSM 302 is typically implemented as a subsea part 301*c* of the WSS. WSM 302 is mounted on the Emergency Disconnect Package ("EDP") 205 and is independent of the Subsea Control Module and Workover Control Module. WSM 302 is the executing part of the WSS. Proposed WSS 301*a,b* and *c* is typically supplied with two WSMs for full redundancy in safety function execution. The WSM is typically a pressure compensated enclosure with manifold mounted directional control valves 303. WSM essentially contains mechanical components, further distinguishing the example embodiments from the previously mentioned prior-art. According to some of the example embodiments, all control logic is located topside where it can easily be accessed and maintained as required.

Directional Control Valves 303: For de-energized-to-close functions, directional Control Valves 303 inside the WSM 302 normally allow the hydraulic output from the WOCM 201 to pass through. Upon initiation of a critical event, for example, an ESD, the Directional Control Valves 303 shift position, dumping the hydraulic output from the Workover Control Module to return. This causes the main bore valves to close according to the hydraulic system design in a traditional workover stack or WCP. The EDP connector normally requires a different functionality, where the WSM 302 blocks an accumulator supply, and in a critical event opens the line in order for the accumulator to pressurize the EDP connector functions. The DCVs 303 can either be electrically held in position (i.e., de-energize to trip), or for example, be normally de-energized (i.e., electrically activated to trip). According to some of the example embodiments, the directional control valves 303 are directly controlled. The DCVs are electrically driven by hardwired signals from the topside Safety Controller, typically using a DC voltage. One or more directional control valve may be controlled by the same DC voltage signal by being coupled in parallel either at the topside or the subsea end of the umbilical.

There are around fourteen subsea valves and around thirteen topside valves, which are operated by the proposed WSS 301*a, b* and *c* in the event of an emergency or critical event. The number of valves depends upon the workover system configuration. FIG. 3 shows an embodiment of a standard open water workover configuration in which the proposed WSS 301*a, b* and *c* operates eleven subsea- and one topside-valves.

One of the main objectives of some of the example embodiments is implementing emergency shutdown functionality in workover systems independent of the WOCS. The emergency shutdown functions are typically, Process Shutdown ("PSD"), Emergency Shutdown ("ESD"), and Emergency Quick Disconnect ("EQD"). These are explained as follows.

It should be appreciated that while FIG. 3 illustrates example interconnections between the WSS, SEM/WOCM, MCU, HPU, etc., not all of such interconnections are illustrated. For example, it should be appreciated that the WSS may be configured to activate the various components or valves within the subsea apparatus, for example, valves 211-252.

Figure 3A:
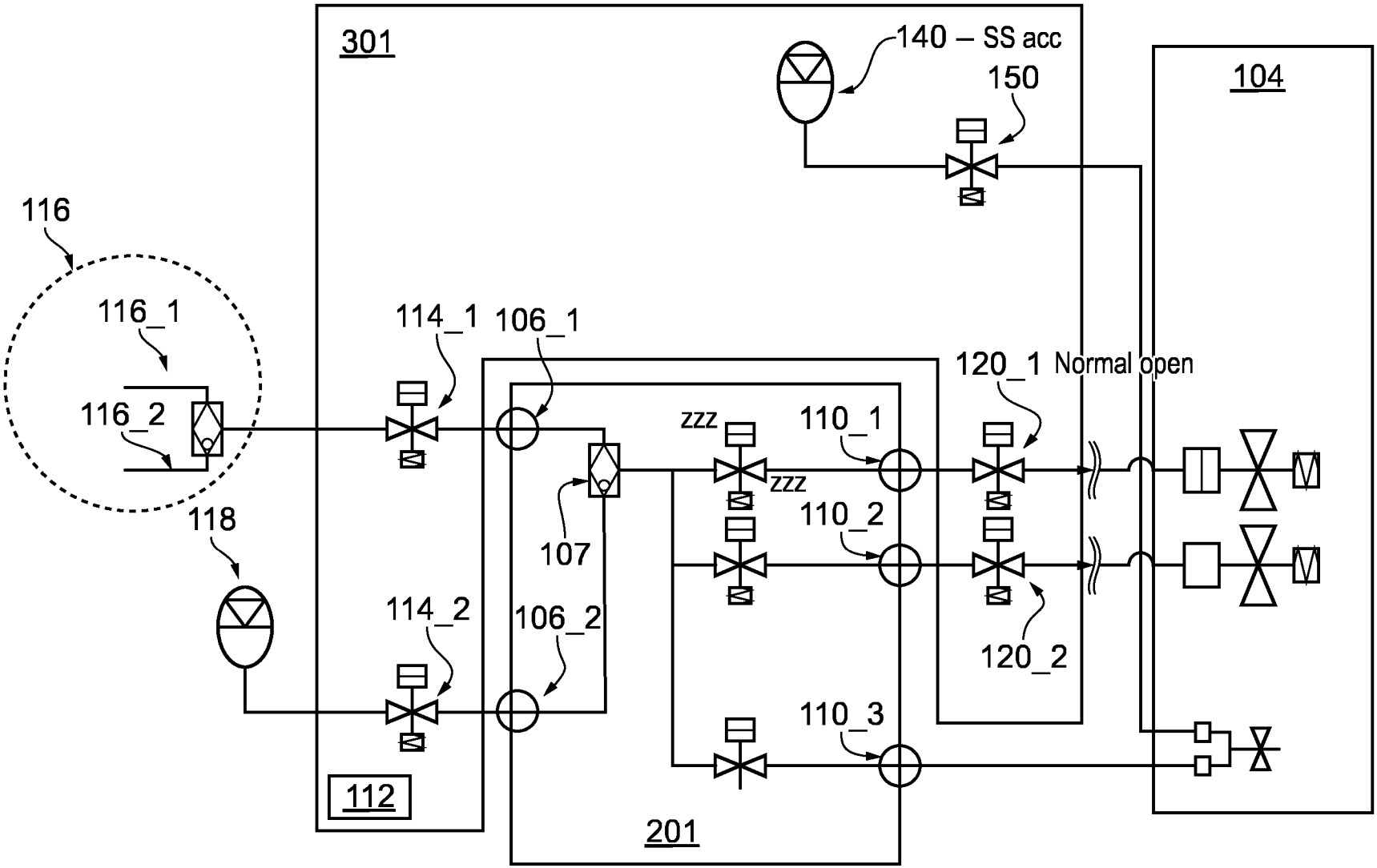
FIG. 3A illustrates an example implementation of a safety system according to some of the example embodiments.

FIG. 3A illustrates an example implementation of the safety system, according to some of the example embodiments. As shown in FIG. 3A, the safety system 301 is situated around a control module 201. According to some of the example embodiments, the control module 201 may be a Workover Control Module, (WOCM), Subsea Electronics Module (SEM), and/or a Riser Control Module (RCM), configured to actuate a component 104 of a hydrocarbon exploitation apparatus. Particularly an apparatus comprising at least one of an Lower Riser Package (LRP), Emergency Disconnect Package (EDP), Blowout Preventer (BOP), Riser Package (RP), a Drilling Package (DP), a Master Control Unit (MCU), and/or a Hydraulic Power Unit (HPU).

The control module 201 is configured to regulate hydraulic fluid or a power flow to the component. The control module may comprise any number of fluid or power sources, for example, source 116 and 118. In the example provided by FIG. 3A, source 116 is a LP hydraulic supply from the topside of the subsea apparatus, and source 118 is a fail-safe accumulator. The sources are configured to provide a fluid or power flow to inputs 106_1 and 106_2 of the control module. The control module accumulates the flow and transmits the flow to various components 104 via outputs 110_1, 110_2 and 110_3.

During normal operation, some gates, for example, vales or relays, within the safety system may initially be in an open position. Specifically, override gates 114_1 and 114_2 may be in an open position during normal operation thereby allowing fluid or power flow from the sources 116 and 118 to be provided to the control module. Similarly, override gates 120_1 and 120_2 may also be in an open position during normal operation to allow for the flow of accumulated fluid or power to be provided from the control unit to the various components 104.

During an emergency event, a trigger 112 may be supplied to the safety system, thereby activating the system. During such activation the overriding gates 1114_1, 114_2, 120_1 and 120_2 may be placed in a closed position, particularly to close a functional line and open a vent line. Once the overriding gates are placed in the closed position, the gates 114_1 and 114_2 prevent the flow of power or fluid from entering the control module, while gates 120_1 and 120_2 prevent the flow of power or fluid from leaving the control module and being supplied to the components. Examples of such components may be pilot valves to valves 211 and 212, 231-234, and pilot valves to connectors 251 and 252.

According to some of the example embodiments, the safety system may further comprise any number of gates which may be used to ensure pressure is supplied to the components during an emergency event. For example pressure gate 150 may be included in the safety system. The pressure gate 150 may be supplied hydraulic fluid or a power flow from a source or accumulator 140.

During normal operation, the pressure gate 150 will be in a closed position. Upon receiving the trigger signal, the safety system will place the pressure gate in an open position thereby allowing the flow to be provided directly to components independently of the control module. Such a flow may provide pressure to components such as to the at least one valve disposed in an EDP, a valve in a RCM, and/or an annular bag disposed within a Blowout Preventer, BOP, to provide a hydraulic pressure, independently of the control module, to the EDP and/or BOP, respectively. Such pressure may be useful, for example, during procedures when various components of the apparatus disengage from each other, for example, during transportation.

It should be appreciated that all of the gates of the safety system of FIG. 3A are independent with respect to the control module. Specifically, the gates of the safety system are separate from the control module with respect to software and hardware and therefore operate independently of the control module. Such a feature adds a further degree of safety as if the control module malfunctions, such operational errors will have no impact on the operation of the safety system. It should be appreciated that such independency is not an obvious variant to the systems illustrated in FIGS. 1 and 2. Specifically, providing the safety system independently with respect to hardware and software requires the use of additional hardware and software resources which adds significant costs to the subsea apparatus thereby discouraging such separation.

Figure 3B:
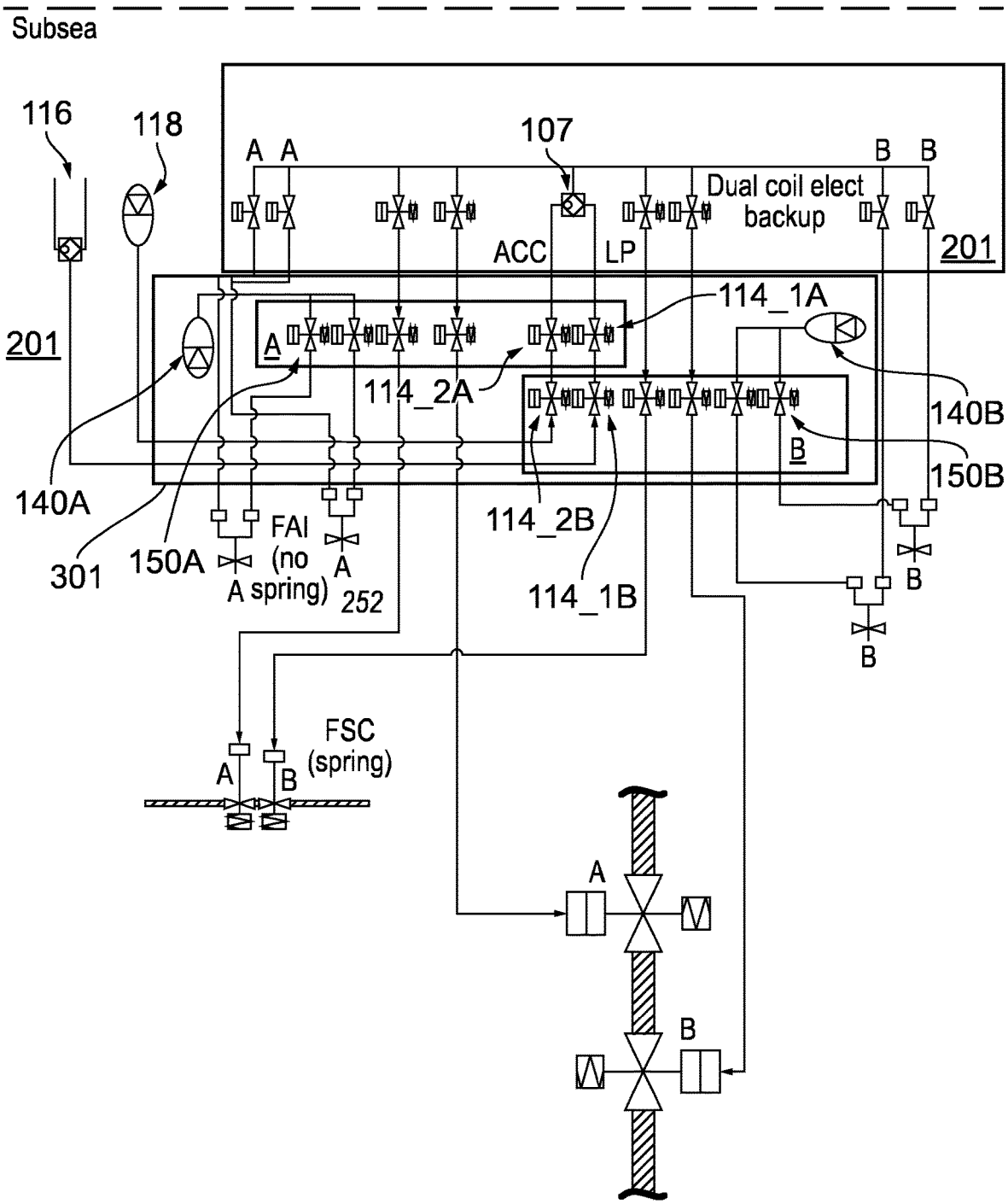
FIG. 3B illustrates an example of an NB redundancy configuration of the system of FIG. 3A, according to some of the example embodiments.

According to some of the example embodiments, such a safety system may also comprise an NB redundancy as illustrated in FIG. 3B. The NB redundancy provides a duplication of the elements of the safety system into two separate components. For example, if an overriding gate 114_1A within the A safety system of the NB redundancy fails, the corresponding overriding gate 114_1B within the B safety system will be configured to be operational in the place of the failed gate in the A system. Thus, the redundancy system adds a further degree of operational integrity to the subsea apparatus in the case of an emergency event.

Figure 3C:
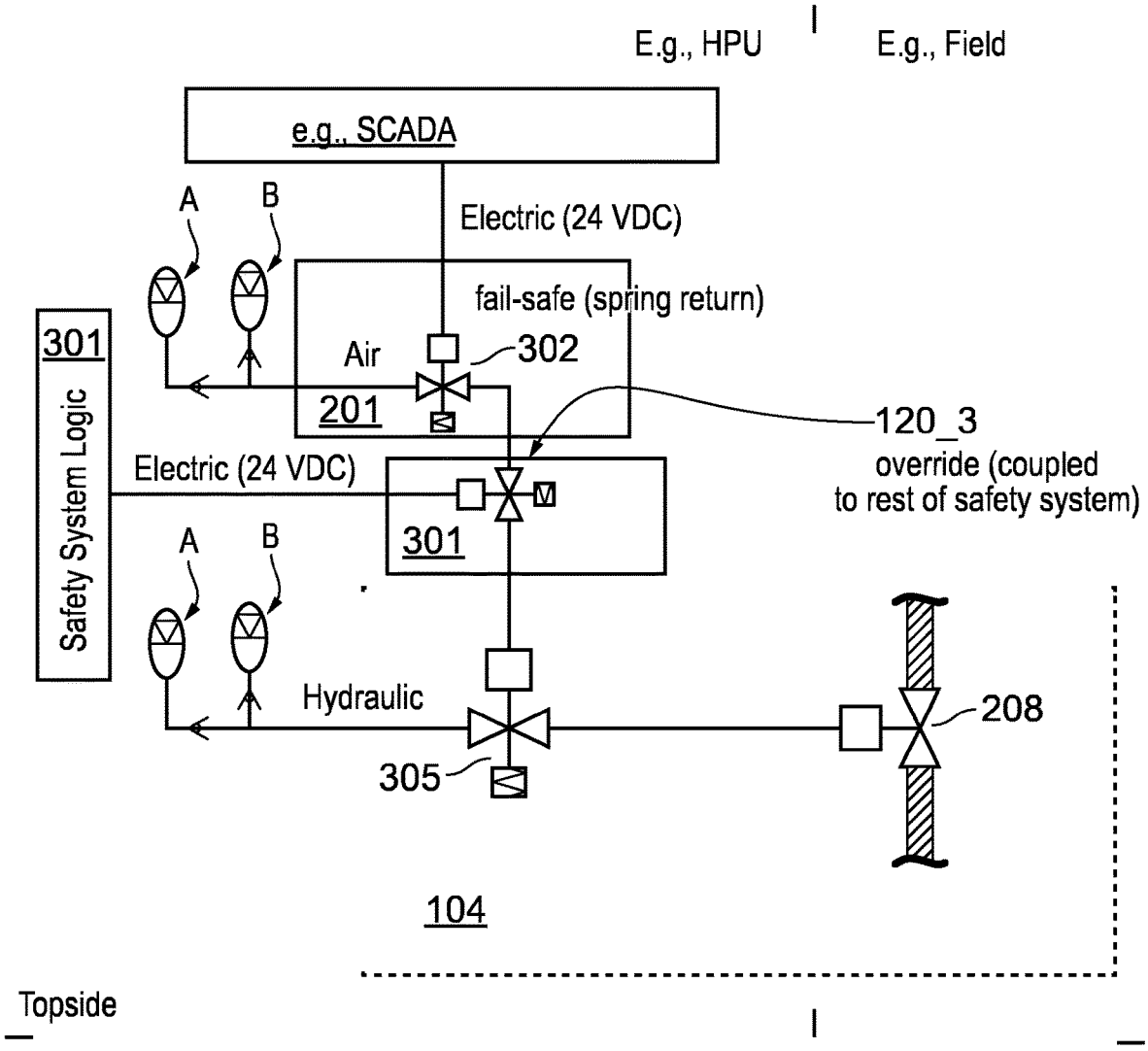
FIG. 3C illustrates a topside component of the safety system, according to some of the example embodiments.
Figure 3D:
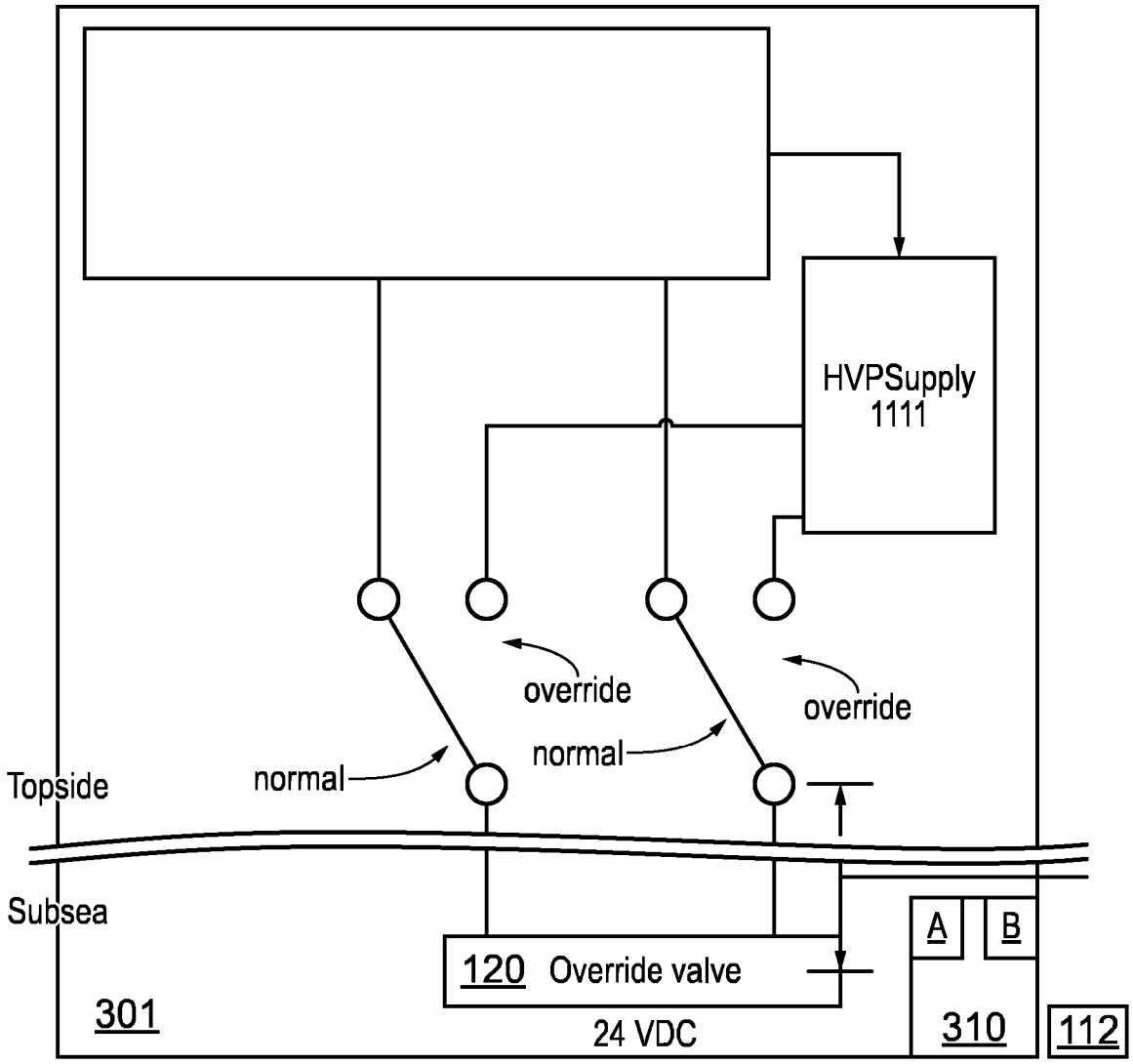
FIG. 3D illustrates a voltage regulation function of the safety system, according to some of the example embodiments.

According to some of the example embodiments, the safety system may also comprise elements which are located on the topside of the subsea apparatus. FIG. 3C illustrates an example of a topside gate of the safety system. As shown in FIG. 3C, an override valve 120_3 is comprised in a series connection between a power source and a pilot valve 305, which in turn is in connection with a SPWV 208. Such devices are components 104 of the subsea apparatus.

In operation, upon receiving the trigger signal, the override valve or gate 120_3 will be placed in a closed position via the safety system. In the closed position, the override valve 120_3 will prevent a fluid or power flow from reaching the pilot valve 305 and therefore such flow will also be prevented from reaching the SPWV 208.

According to some of the example embodiments, the safety system may further comprise a power management system 310. The power management system 310 may ensure that the control module is operating with a supplied voltage within a threshold. It should be appreciated that the control module may be hundreds of miles below the sea level. Thus, a voltage supplied topside will endure an amount of electrical resistance by the time such voltage reaches the control module. According to some of the example embodiments, the power management system 310 may be configured to periodically measure a subsea received voltage. In comparing the received voltage value with the value of the voltage which was transmitted, the control module may determine a current resistance associated with the voltage traveling via the umbilical. With knowledge of the resistance, the amount of the transmitted voltage may be altered to ensure that the voltage provided to the control module is within a predetermined threshold to ensure that the module is operating properly.

Specifically, according to some of the example embodiments may be directed towards a power management system comprising a trigger input. The system further comprises a logic device comprising a processor, memory, and instructions stored in the memory and executable by the processor. The logic device coupled to the trigger input, the logic device configured to be coupled to an umbilical including a power line, particularly an umbilical having a length greater than 300 meters, particularly greater than 1000 meters. The system also comprises at least one valve connected to the power line, particularly at least one of an override valve and an accumulator valve.

The system further comprises a power supply coupled to the logic device, particularly a DC power supply, particularly configured to deliver at least 30 volts, particularly up to about 500 volts, particularly a discrete power supply or a power supply integrated with the logic, the power supply configured to actuate the valve via the power line when connected to the valve. The system also comprises a switch, particularly a relay, coupled to the logic device and power supply, the switch operable by the logic device to switch between: a monitoring condition, in which the power supply is not connected to the valve, and an override condition, in which the power supply is connected to the valve.

The logic device configured to perform a method comprising measuring a parameter characterizing an electrical circuit including the power line and valve; calculating a topside voltage expected to result in a desired voltage at the valve when delivered via the umbilical, the desired voltage sufficient to actuate the valve; and transmitting the calculated topside voltage to the power supply.

According to some of the example embodiments the power management system may further measure via applying a non-actuating voltage to the power line; measuring a current resulting from the applied voltage; normalizing the measured current to a resistance of the valve, particularly subtracting a resistance of the valve; and calculating a resistance of the umbilical using the normalized current.

According to some of the example embodiments, the logic device is further configured to receive a trigger signal via the trigger input (112); and operate the switch to change from the monitoring condition to the override condition to actuate the valve using the power supply.

Various concepts related to the example embodiments will now be discussed in greater detail.

Key features of the PSD function are:

1. PSD closes side outlets in the surface flow tree 209 of a workover system, for example, the Surface Production Wing Valve ("SPWV") 208.
2. For riser-based workover systems, PSD is typically executed topside only, and does not as such require communications through the workover umbilical. In riserless workover systems, PSD is a function on the XT, normally controlled by WCP and overridden by WSS in critical events
3. It is usually push-button initiated.
4. PSD can also be initiated by the process facility internal ESD function.
5. PSD can also be initiated by the vessel/rig Safety and Automation System's ESD function.
6. PSD is a fail-safe, usually fail-safe-close, type safety function, upon loss of electrical and/or hydraulic power.
7. PSD is usually a de-energize-to-trip safety function, meaning the final element is opened by powering, for example, by electrical, pneumatic, or hydraulic power, or their combination. Cutting the power to the final element causes the safety function to revert to safe state.
8. Safe state for the system in this case is, rig/vessel process facility isolated from riser/hydrocarbon return content, typically within 5 seconds of initiation of the PSD event.
9. Electrical power supply, usually sourced through UPS, is shared with the WOCS.
10. Hydraulic and/or pneumatic power supply is usually not required for the PSD function, however said hydraulic/pneumatic supply is normally used to hold the SPWV 208 open. Without the WSS as proposed in some of the example embodiments, electric power keeps a pneumatic valve open, which keeps a DCV open, which further keeps the SPWV 208 pressurized to stay open. With the proposed WSS a second DCV is added; electric power keeps the WSS DCV open (i.e., said DCV is electrically held open), which keeps the SPWV 208 pressurized to stay open.

Figure 4:
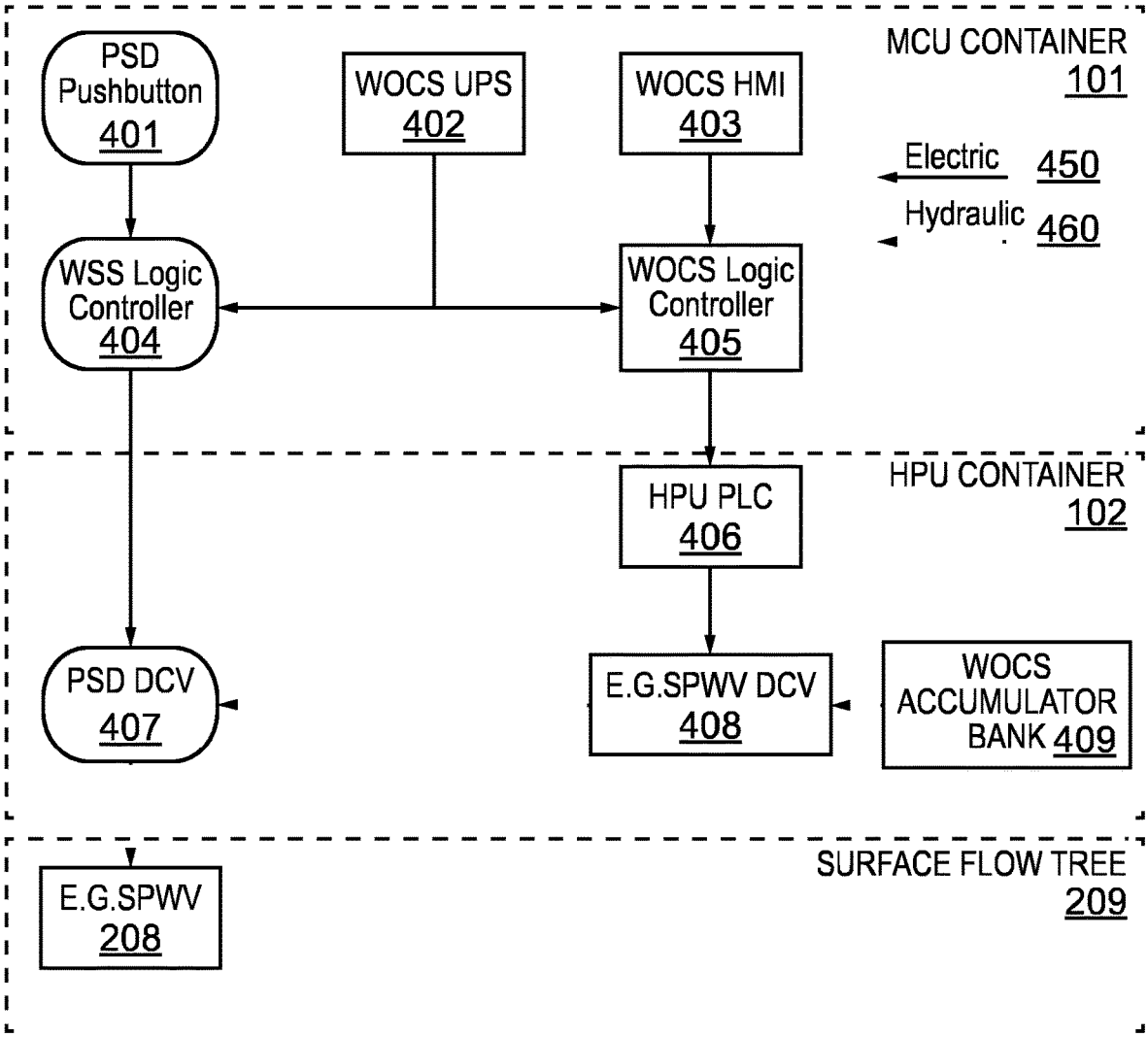
FIG. 4 illustrates an embodiment of the Process Shutdown ("PSD") function according to some of the example embodiments.

FIG. 4 shows a typical PSD principle sketch according to some of the example embodiments. The arrows with solid lines as in 450 represent electrical signals, whereas dashed lines as in 460 represent hydraulic signals. A person skilled in the art will understand that alternative embodiments are possible by extending, reducing, replacing or combining the scope of hydraulic and electric signals. In some embodiments, achieving similar functionality with an alternative power source such as pneumatic is also possible. Specific embodiments are hence, presented in a general sense for the sake of simplicity and without limiting the scope of the example embodiments.

The rounded blocks, 401, 404 and 407, in FIG. 4 represent the WSS components according to some of the example embodiments, whereas the rest of the blocks (rectangular) represent here WOCS components.

As discussed previously, Uninterruptable Power Supply ("UPS") 402 is shared between the WOCS part 405 and WSS part 404.

WOCS is accessible to the operator, typically through a Human Machine Interface ("HMI") 403 located in the topside part, for example, the MCU container 101. WOCS HMI interacts with a WOCS logic controller 405, said controller further interacting with a HPU controller 406, for example, a Programmable Logic Controller ("PLC"), typically located in an HPU container 102. The HPU PLC 406 controls a Surface Production Wing Valve ("SPWV") Directional Control Valve (DCV) 408. Said SPWV DCV 408 controls the hydraulic power supply from WOCS Accumulator Bank 409. Said hydraulic power supply is used for activating SPWV 208 located topside, typically in Surface Flow Tree 209.

The WSS part according to some of the example embodiments is shown in round shaped blocks, 401, 404 and 407. PSD sequence in WSS is activated through a pushbutton 401 that transmits a PSD event to a WSS logic controller 404. Some example embodiments of WSS logic controller include PLC. In further embodiments, the system also includes relay to switch in a higher voltage, insulation line monitoring logic, and Ohmmeter for line monitoring. Relay to switch in a higher voltage is typically not required for PSD, as PSD is usually a de-energize to trip type function. The WSS Logic Controller 404 controls a dedicated PSD DCV 407 to bleed off the hydraulic supply to the Surface Flow Tree Side outlets in order to override the WOCS.

The PSD safety function is typically used when there are major disrupting events in the process facility, for example hydrocarbon leakages in the production facility, or in hoses from the Surface Flow Tree 209 to the production facility.

Key features of the ESD function are:

1. ESD typically closes all (usually three) main bore valves and all annulus bore valves in the well control package, i.e., the subsea part of the workover system.
2. ESD function typically requires communication through the workover umbilical or through a similar communications cable from topside system to subsea system.
3. ESD is typically pushbutton activated/initiated.
4. ESD function can be initiated by the vessel/rig safety and automation system's ESD function.
5. ESD function is typically provided with an additional spare instrumented initiator port for future automatic initiation functionality.
6. ESD is typically a fail-as-is type safety function upon loss of electrical or hydraulic power. In other words, ESD is fail-safe as is type function upon loss of one of power types subsea. In the event that both electrical and hydraulic powers fail simultaneously, ESD is typically a fail-safe close function.
7. ESD is typically an energize-to-trip safety function, meaning that the final element is brought to safe state by applying, power, for example, electrical, hydraulic, pneumatic, or their combination. Cutting the supply of said power does not normally cause the safety function to go to safe state.
8. By safe state, it is here meant that the rig/vessel and environment being isolated from the reservoir content.
9. Electrical power supply, usually sourced through UPS, is usually shared with the WOCS. Upon complete loss of electrical power, e.g., loss of UPS, the system will go to safe state by inherent fail-safe-close functionality, however, not necessarily within the timing requirements for the ESD function.
10. Hydraulic power supply used for close assist for the main bore valves is also typically shared with the WOCS.
11. Hydraulic power supply for pilot functions is typically not required in this function.
12. The ESD function typically further initiates the PSD function described above.

Figure 5:
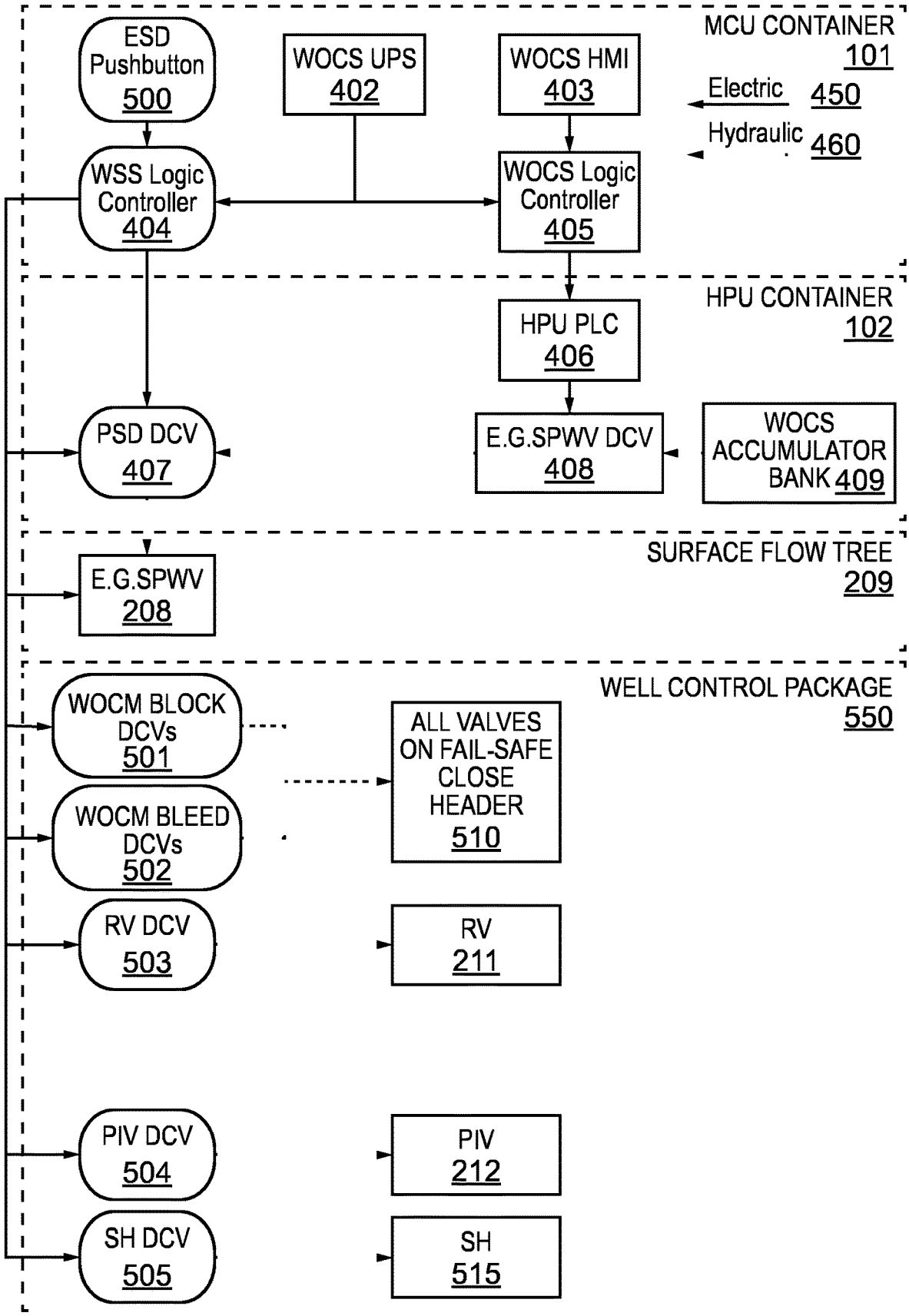
FIG. 5 illustrates an embodiment of the Emergency Shutdown ("ESD") function according to some of the example embodiments.

Some example embodiments of the ESD functionality according to some of the example embodiments is shown in FIG. 5. The arrows with solid lines 450 represent electrical signals, whereas dashed lines 460 represent hydraulic signals. A person skilled in the art will understand that alternative embodiments are possible by extending, reducing, replacing or combining the scope of hydraulic and electric signals. In some embodiments, achieving similar functionality with an alternative power source such as pneumatic is also possible. Specific embodiments are, hence, presented here in a general sense for the sake of simplicity and without limiting the scope of the example embodiments.

The rounded blocks, 500, 404, 407, 501, 502, 503, 504, and 505 shown in FIG. 5 represent the WSS components according to some of the example embodiments, whereas the rest of the blocks represent here WOCS components.

As discussed previously, Uninterruptable Power Supply ("UPS") 402 may be shared between the WOCS part 405 and WSS part 404.

WOCS functionality shown in FIG. 5 is similar to that explained in the discussion of FIG. 4 above.

ESD sequence is activated/initiated through a pushbutton 500 that transmits an ESD event to the WSS logic controller 404. The interactions of the WSS controller 404 with PSD DCV 407 and SPWV 208 are disclosed in the discussion of FIG. 4 above. Proposed embodiments of the WSS logic controller 404 have also been discussed above.

According to some of the example embodiments, one or more subsea canisters, mounted on the Emergency Disconnect Package ("EDP") 205, usually in the upper part of the Well Control Package 550, typically comprises 14 DCVs (comprising 501-505) to enable an independent control of the final elements, including, a. Retainer Valve ("RV") 211
b. EDP Sea Dump Valve 241 (not shown in FIG. 5)
c. Production Isolation Valve ("PIV") 212
d. Safety Head ("SH") 515. SH 515 is a ram type valve designed for isolating coiled tubing. It typically has better isolating/cutting capabilities than gate valves and is used to reduce risk in some systems. Alternatively, other systems use three gate valves, the SH 515 is then absent and a gate valve is inserted to replace it, the inserted gate valve is often called Lower Production Isolation Valve ("LPIV")
e. LRP Sea Dump Valve 242 (not shown in FIG. 5)
f. Workover Control Module hydraulic supply (not entirely shown in FIG. 5)
g. Workover Control Module internal hydraulics (not specifically shown in FIG. 5)
h. Bleed-Off Valve ("BOV") (not shown in any figures)—EQD only (used to prevent hydraulic lock (vacuum) when disconnection EDP from LRP)
i. E.g. Upper Methanol Injection Valve ("UMIV") (not shown in figures)—EQD only (redundant to BOV)
j. Emergency Disconnect Package Connector Primary Unlock 251—EQD function only (not shown in FIG. 5)
k. Emergency Disconnect Package Connector Secondary Unlock 252—EQD function only (not shown in FIG. 5)

l. Spare functionality

The ESD safety function is typically activated only when there is a major hydrocarbon leakage either on the vessel/rig or in the riser/hydrocarbon return line. The ESD function is initiated typically by a pushbutton 500, thereby sending a signal to the WSS Controller 404, said safety Controller 404 may be a relay based controller, to initiate the shutdown sequence. Upon receiving said signal, the safety controller 404 further notifies the process control system of the initiation. The shutdown sequence is performed by the safety controller 404. According to another embodiment, the safety controller 404 is at least partially a PLC. The typical steps are as follows (not necessarily in the same order)

1. Safety Controller 404 sends a signal to the WOCS notifying the process control system of the ESD initiation.
2. Safety Controller 404 sends a signal, may be an electrical signal, to the DCV 503 bleeding off the pilot pressure on the open side of the RV high-flow DCV, thereby causing the RV 211 to close. The same signal is also sent to the DCV bleeding off the pilot pressure on the close side of the EDP Sea Dump Valve, thereby causing the EDP Sea Dump Valve 241 to open. This allows for a shorter closing time for the RV 211.
3. Safety Controller 404 sends a signal, may be an electrical signal, to the DCV bleeding off the pilot pressure on the open side of the PIV high-flow DCV, thereby causing the PIV 212 to close. The same signal is also sent to the DCV bleeding off the pilot pressure on the close side of the LRP Sea Dump Valve, thereby causing the LRP Sea Dump 242 Valve to open. This allows for a shorter closing time for the PIV 212.
4. Safety Controller 404 sends a signal, may be an electrical signal, to the two DCVs 501 and 502 bleeding off the low-pressure hydraulic supply to the Workover Control Module, thereby leading all the valves 510 in the Well Control Package 550 to fail-safe.
5. Safety Controller 404 sends a signal, may be an electrical signal, to the two DCVs bleeding off the internal hydraulics of the Workover Control Module, thereby further enabling a shorter fail-safe response of the Well Control Package 550.
6. Safety Controller 404 sends a signal, may be an electrical signal, to the DCV bleeding off the pilot pressure on the open side of the Safety Head high-flow DCV, thereby causing the Safety Head 515 to close.

Key features of the EQD function are:

1. EQD typically closes all (usually three) main bore valves and all annulus bore valves in the well control package 550, i.e., the subsea part of the workover system. EQD further disconnects EDP 205 from LRP 204, in other words, the upper and the lower parts of the WCP 550 are disconnected.
2. EQD function typically requires communication through the workover umbilical or through a similar communications cable from topside system to subsea system.
3. EQD is typically pushbutton activated/initiated.
4. EQD function can be initiated by the vessel/rig safety and automation system's ESD function.
5. EQD function is typically provided with an additional spare instrumented initiator port for future automatic initiation functionality.
6. EQD is typically a fail-as-is type safety function upon loss of electrical and/or hydraulic power. This is because in this case it is safer to be in a fail-safe-as-is state and remain connected upon failure rather than to disconnect spuriously.
7. EQD is typically an energize-to-trip safety function, meaning that the final element is brought to safe state by applying, power, for example, electrical, hydraulic, pneumatic, or their combination. Cutting the supply of said power does not normally cause the safety function to go to safe state.
8. By safe state, it is here meant that the rig/vessel and environment being isolated from the well/reservoir content and further, said rig/vessel being disconnected from the well.
9. Electrical power supply, usually sourced through UPS, is usually shared with the WOCS. Upon complete loss of electrical power, e.g., loss of UPS, the system will go to safe state by inherent fail-safe-close functionality, however, not necessarily within the timing requirements for the EQD function.
10. Hydraulic power supply used for close assist for the main bore valves is also typically shared with the WOCS.
11. Hydraulic power supply for pilot functions of the EDP 205 may be supplied through separate accumulators.
12. The EQD function typically further initiates the PSD function as described above.

Figure 6:
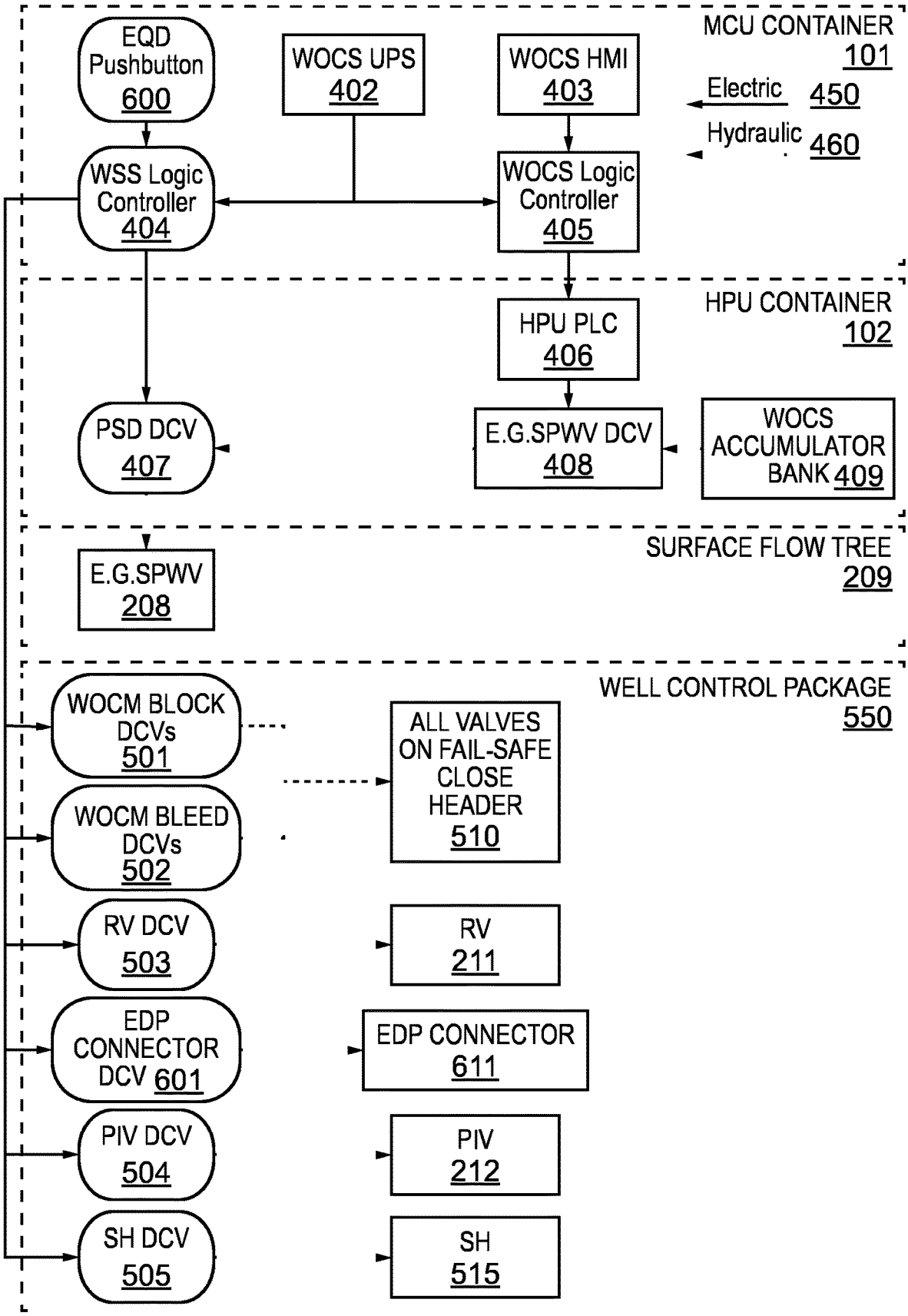
FIG. 6 illustrates an embodiment of the Emergency Quick Disconnect ("EQD") function according to some of the example embodiments.

Some of the example embodiments of the EQD functionality is shown in FIG. 6. The arrows with solid lines 450 represent electrical signals, whereas dashed lines 460 represent hydraulic signals. A person skilled in the art will understand that alternative embodiments are possible by extending, reducing, replacing or combining the scope of hydraulic and electric signals. In some embodiments, achieving similar functionality with an alternative power source such as pneumatic is also possible. Specific embodiments are, hence, presented in a general sense for the sake of simplicity and without limiting the scope of the example embodiments.

The rounded blocks, 600, 404, 407, 501, 502, 503, 504, 505, and 601 shown in FIG. 6 represent the WSS sequence according to some of the example embodiments, whereas the rest of the blocks represent here WOCS sequence.

As discussed previously, Uninterruptable Power Supply ("UPS") 402 may be shared between the WOCS part 405 and WSS part 404.

WOCS functionality shown in FIG. 6 is similar to that explained in the discussion of FIG. 4 above.

EQD sequence is activated/initiated through a pushbutton 600 that transmits an EQD event to the WSS logic controller 404. The interactions of the WSS controller 404 with PSD DCV 407 and SPWV 208 are disclosed in the discussion of FIG. 4 above. Proposed embodiments of the WSS logic controller 404 have also been discussed above.

According to some of the example embodiments, one or more subsea canisters, mounted on the Emergency Disconnect Package ("EDP"), usually in the upper part of the Well Control Package 550, typically comprises 14 DCVs to enable an independent control of the final elements, including, a. Retainer Valve ("RV") 211
b. EDP Sea Dump Valve 241 (not shown in FIG. 5)
c. Production Isolation Valve ("PIV") 212
d. Safety Head ("SH") 515
e. LRP Sea Dump Valve 242 (not shown in FIG. 5)
f. Workover Control Module hydraulic supply (not entirely shown in FIG. 6)
g. Workover Control Module internal hydraulics (not specifically shown in FIG. 6)
h. BOV—see list in ESD function for description
i. UMIV—see list in ESD function for description j. Emergency Disconnect Package Connector Primary Unlock 251 (shown as a general block, EDP Connector 611, in FIG. 6)

k. Emergency Disconnect Package Connector Secondary Unlock 252 (shown as a general block, EDP Connector 611 controllable by EDP connector DCV 601, in FIG. 6)

l. Spare function

The EQD is normally initiated when the rig/vessel loses position (drive off/drift off) or when a major hydrocarbon leakage is not contained by the ESD and the rig/vessel needs to move off location as soon as possible. The EQD function is initiated typically by a pushbutton 600, thereby sending a signal to the WSS Controller 404, said safety controller 404 is a relay based controller, but it can also be at least partially a PLC, to initiate the shutdown sequence. Upon receiving said signal, the safety controller 404 further notifies the process control system of the initiation. The shutdown sequence is performed by the safety controller 404. The typical steps are as follows (not necessarily in the same order)

1. Safety Controller 404 sends a signal to the WOCS notifying the process control system of the EQD initiation.
2. Safety Controller 404 sends a signal, for example, an electrical signal, to the DCV bleeding off the pilot pressure on the open side of the RV high-flow DCV, thereby causing the RV 211 to close. The same signal is also sent to the DCV bleeding off the pilot pressure on the close side of the EDP Sea Dump Valve, thereby causing the EDP Sea Dump Valve 241 to open. This allows for a shorter closing time for the RV 211.
3. Safety Controller 404 sends a signal for example, an electrical signal, to the DCV bleeding off the pilot pressure on the open side of the PIV high-flow DCV, thereby causing the PIV 212 to close. The same signal is also sent to the DCV bleeding off the pilot pressure on the close side of the LRP Sea Dump Valve, thereby causing the LRP Sea Dump 242 Valve to open. This allows for a shorter closing time for the PIV 212.
4. Safety Controller 404 sends a signal, for example, an electrical signal, to the two DCVs bleeding off the low-pressure hydraulic supply to the Workover Control Module, thereby leading all the valves 510 in the Well Control Package 550 to fail-save.
5. Safety Controller 404 sends a signal, for example, an electrical signal, to the two DCVs bleeding off the internal hydraulics of the Workover Control Module, thereby further enabling a shorter fail-safe response of the Well Control Package 550.
6. Safety Controller 404 sends a signal, for example, an electrical signal, to the DCVs applying pilot pressure to the Connector Primary and Secondary functions.
7. Safety Controller 404 sends a signal, for example, an electrical signal, to the DCV bleeding off the pilot pressure on the open side of the Safety Head high-flow DCV, thereby causing the Safety Head 515 to close.

Some of the example embodiments results in the following example advantages with respect to the conventional WOCS based systems, the main ones are listed below.

For PSD functionality, the some of the example embodiments result in,

1. The safety related system and functionality physically separated from the process control system and functionality—thereby resulting in an independent, fast and reliable system with enhanced safety.
2. Flexibility for use in different types of workover systems including, open-water workover system (as discussed above), landing string, riserless workover system, through-tubing rotary drilling workover system, and their likes or combinations.
3. Hardware override of the process control system by the safety system.

For ESD functionality, some of the example embodiments result in,

1. The safety related system and functionality physically separated from the process control system and functionality—thereby resulting in an independent, fast and reliable system with enhanced safety.
2. Hardware override of the process control system by the safety system, for example using hydraulic piping as shown in the above discussion. Equivalents in electrical, pneumatic, or other systems are also possible.
3. Relatively simplified safety function, making the safety functionality highly reliable and robust. In addition, any fault detection in the system is also easier, thereby resulting in high availability of the system.
4. Subsea retrievable process control without the loss of safety functionality or integrity.
5. Flexibility for use in different types of workover systems including, open-water workover system (as discussed above), landing string, riserless workover system, through-tubing rotary drilling workover system, and their likes or combinations.

For EQD functionality, some of the example embodiments result in,

1. The safety related system and functionality physically separated from the process control system and functionality—thereby resulting in an independent, fast and reliable system with enhanced safety.
2. Physically segregated hydraulic supply for the pilot stages of connector unlock.
3. Hardware override of the process control system by the safety system, for example using hydraulic piping as shown in the above discussion. Equivalents in electrical, pneumatic, or other systems are also possible.
4. Relatively simplified safety function, making the safety functionality highly reliable and robust. In addition, any fault detection in the system is also easier, thereby resulting in high availability of the system.
5. Subsea retrievable process control without the loss of safety functionality or integrity.
6. Flexibility for use in different types of workover systems including, open-water workover system (as discussed above), landing string, riserless workover system, through-tubing rotary drilling workover system, and their likes or combinations.

Another object of some of the example embodiments is to enhance the reliability and robustness of the existing components in a typical workover system or in similar systems. Some of the example embodiments propose the following changes to the hydraulic supply, electrical power supply, and power management areas for the WSS to enhance the safety and reliability for safety systems, and to meet newer regulatory safety requirements.

The more recent regulatory requirements demand, for example,

1. IEC 61511-1 11.2.11: For subsystems that on loss of power do not fail to the safe state, all of the following requirements shall be met and action taken according to 11.3
   a. Loss of circuit integrity is detected (for example, end-of-line monitoring);

b. Power-supply integrity is ensured using supplemental power supply (for example, battery back-up, uninterruptible power supplies);

c. Loss of power to the system is detected

2. IEC 61511-1 11.2.4: If it is intended not to qualify the basic process control system to this standard, then the basic process control system shall be designed to be separate and independent to the extent that the functional integrity of the safety instrumented system is not compromised.

NOTE 1 Operating information may be exchanged but should not compromise the functional safety of the Safety Instrumented System ("SIS").

NOTE 2 Devices of the SIS may also be used for functions of the basic process control system if it can be shown that a failure of the basic process control system does not compromise the safety instrumented functions of the safety instrumented system.

Item 1 above is interpreted as to require monitoring and surveillance of the hydraulic power supply and the use of accumulators to store power. For SIL2 achievement it is assumed redundant accumulation is required and sufficient. The accumulators shall be monitored for preventive maintenance using the Basic Process Control System ("BPCS") and for detection of loss of hydraulic power using the Safety Instrumented System ("SIS"). The term SIL2 should be known to the person skilled in the art; SIL2 stand for Safety Integrity Level 2—which means that the probability of failure is in the order between 10-2-10-3, and certain requirements to system architecture and project execution shall be met.

Item 2 is interpreted as to require the SIS to be segregated from the basic process control system to the extent possible, and that any and all shared elements and/or communication links cannot adversely affect the SIS.

The following realization is proposed to meet and surpass the safety regulations.

The Workover Control System ("WOCS") is provided with redundant accumulator banks, both for low-pressure ("LP") and high-pressure ("HP") functions; WOCS LP A and WOCS LP B. Both the banks are dimensioned to keep the BPCS live for a minimum of one hour upon loss of vessel/rig power supply, for example, upon loss of power to hydraulic pumps. Due to requirements and margins for the calculations of the accumulator dimensioning, the accumulators can normally maintain the BPCS live longer than the minimum requirement of one hour.

The WOCS accumulators 409 further ensure the ability of the WOCS Operator to manually take the system to its defined safe state. Depending upon the specific operating conditions, required steps to reach the safe state may vary. The accumulators 409 are normally located in the WOCS Hydraulic Power Unit ("HPU") 102.

Figure 7:
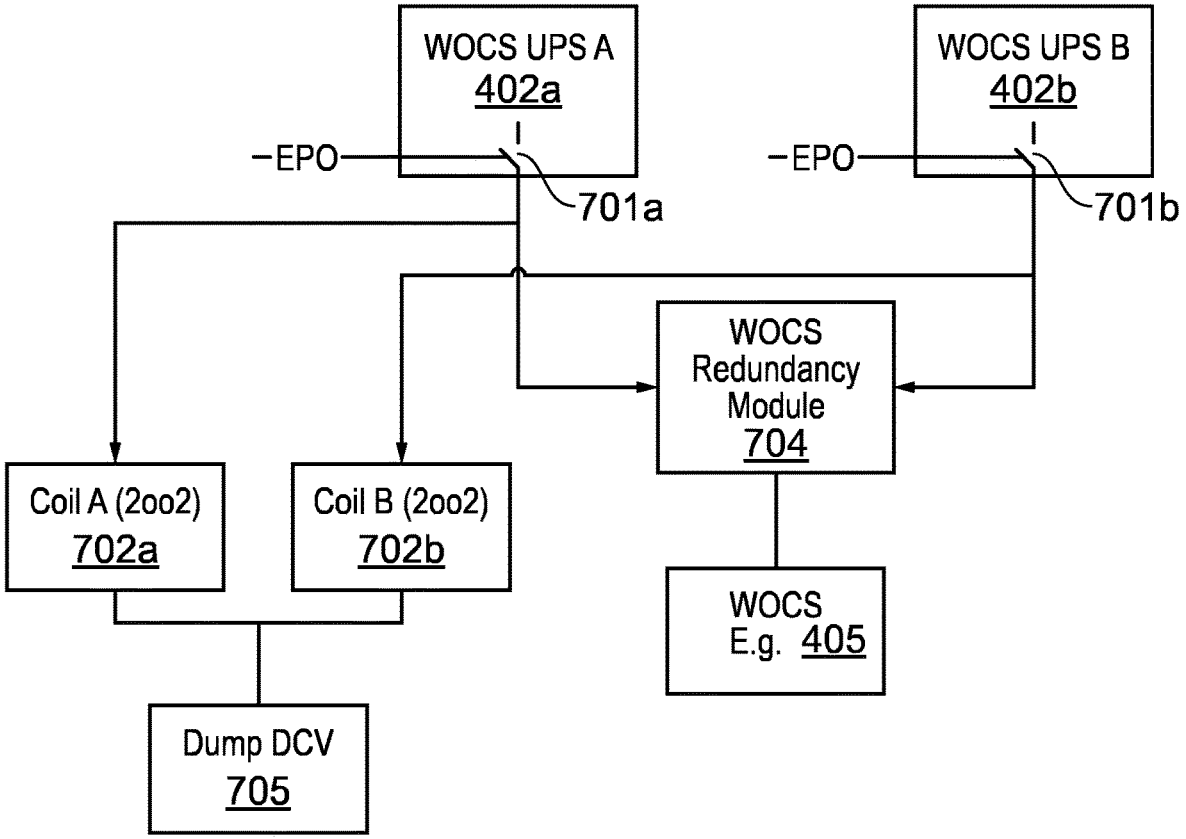
FIG. 7 illustrates an embodiment of the Uninterruptible Power Supply ("UPS") philosophy according to some of the example embodiments.

Now referring to FIG. 7. Due to the overall rig/vessel philosophy the WOCS UPSs 402*a* and 402*b* are equipped with an electrically held switch 701*a* and 701*b*, Emergency Power Off ("EPO"), with which the vessel/rig ESD system may override the UPS setting and switch-off all power on the vessel/rig in the event of emergency. This in turn initiates an electrically held dump valve 705 (held directly by the WOCS UPSs 402*a* and 402*b* in a two-out-of-two ("2oo2") voting using coils 702*a* and 702*b*). The dump valve bleeds off the hydraulic pressure in the WOCS HPU, causing the BPCS to go to its defined safe state, i.e., well sealed and all functions de-energized. WOCS redundancy module 704 makes sure that WOCS 405 receives power even if one of the UPSs, 402*a* or 402*b*, fails.

In some embodiments, the quick disconnect function is unavailable, but the acoustic back-up, ROV override and riser weak link are normally available. The acoustic back-up and ROV override are means of initiating the EDP connector disconnect when the WCP has lost electric and hydraulic power supply (e.g. after EPO). Riser weak link is a mechanical function wherein one of the riser joints is designed to rupture when overloaded, allowing the rig/vessel to drive off/drift off and bringing the WCP to fail-safe-close due to loss of electric and hydraulic power. These are additional protection layers to the Emergency Quick Disconnect. EQD is the Safety Instrumented Function ("SIF") required if the rig/vessel loses position while the workover system is connected to the well.

The Workover Safety System ("WSS") includes safety functions relying on topside accumulated hydraulic and electric power to reach safe state, such as direct hydraulic landing string Emergency Shutdown (where the barrier elements within the Sub Surface Test Tree require hydraulic power to cut, close and seal the high-pressure well bore). Because of this, the proposed WSS provides hydraulic power to this function with sufficiently high reliability for meeting the SIL2 requirements.

Some of the example embodiments propose the following two embodiments illustrating the implementation of the accumulator philosophy.

Embodiment 1: Shared Accumulator Banks

Figure 8:
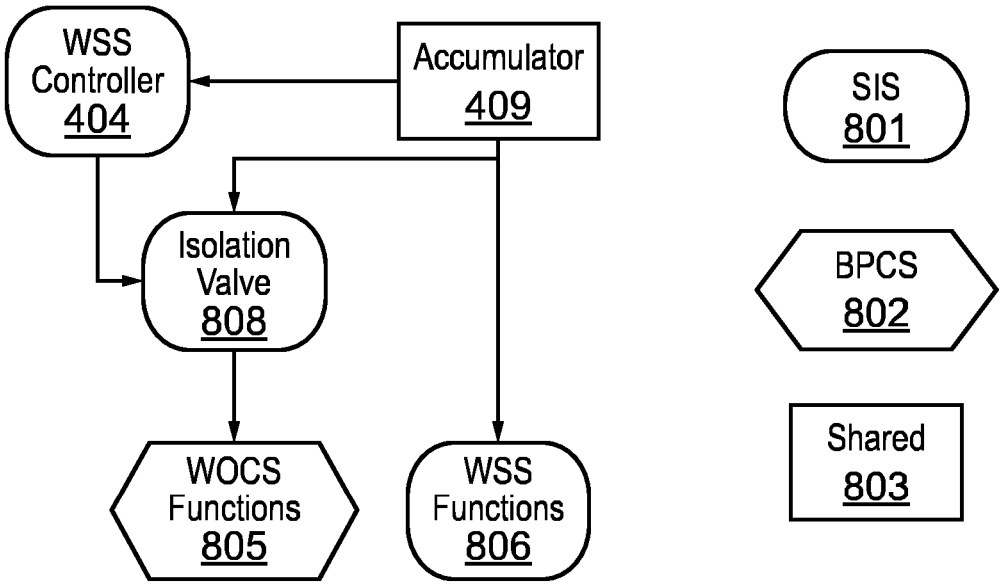
FIG. 8 illustrates a first embodiment of the accumulator philosophy according to some of the example embodiments.

A simplified overview of the first embodiment is shown in FIG. 8. Here, the rounded blocks as in the shape of box "801" represent the modules/functionality as proposed in some of the example embodiments. The blocks with hexagonal shape as of the block "802" represent here Basic Process Control System ("BPCS") functionality. BPCS is another name for the WOCS. The rest of the blocks, as in "803", represent here shared functionality between SIS and BPCS. For the sake of simplicity, single components are shown in FIG. 8, however the same philosophy applies also to a plurality of components, for example accumulator 409 can also be a plurality of accumulators.

As shown in FIG. 8, the accumulator 409 supplies hydraulic power for both the WSS functions 806, and WOCS functions 805. An isolation valve 808 is placed between the accumulator 409 and the WOCS functionality 805 according to some of the example embodiments. Said isolation valve 808 is controlled by the WSS controller 404 that also monitors the parameters of the accumulator 409. Said parameters monitored by the WSS controller 404 include pressure and accumulator level. When said parameters reach their predetermined limit, for example when the pressure falls below a certain limit, the WSS controller 404 closes the isolation valve 808 such that the hydraulic capacity stored in the accumulator 409 is reserved for critical functions, i.e. WSS function 806. By doing so, the system is able to ensure that enough hydraulic supply will be available to execute the safety functions and thereby securing the vessel or plant. When the parameters come back within safe limits, the WSS controller 404 opens the isolation valve 808 to allow WOCS functions 805 to be executed.

When the SIS cuts off supply to the BPCS ensuring ability to control safety critical functions, the BPCS is normally forced to go to safe state automatically due to loss of hydraulic power to hold barrier valves open.

The accumulator 409 is monitored by the SIS and monitoring information is shared with the BPCS/WOCS using a communication link, for example, the existing one-way Modbus link, between SIS and BPCS (not shown in FIG. 8).

Figure 9:
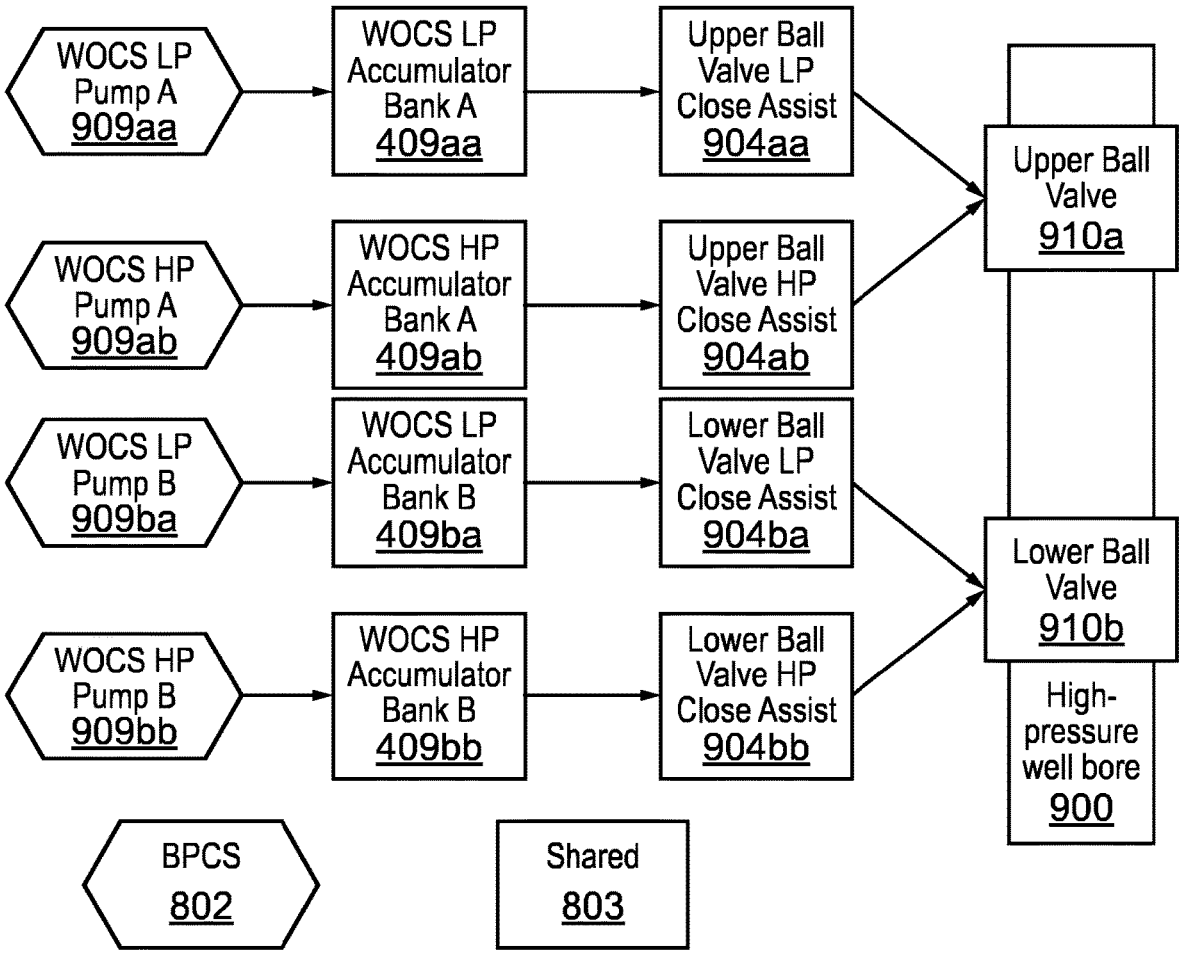
FIG. 9 illustrates an embodiment of the landing string ESD function according to some of the example embodiments when using the first embodiment of the accumulator philosophy.

FIG. 9 shows a typical overview of system as it will look as implemented, in this case for controlling a high-pressure well bore 900 through ball-valves 910*a* and 910*b*, according to the present embodiment of accumulator philosophy. The accumulators 409*aa*, 409*ab*, 409*ba*, and 409*bb* are shared between the SIS and the BPCS functionality. Also, valves 904*aa*, 904*ab*, 904*ba*, and 904*bb*, as well as 910*a* and 910*b* are shared between the SIS and BPCS functions. The hydraulic pumps 909*aa*, 909*ab*, 909*ba*, and 909*bb* are controlled and monitored by the BPCS. This is done to keep the SIS simple and limited to safety critical functions, thereby achieving advantages including increased robustness and reduced response time of the system. As can be seen from FIG. 9, the BPCS accumulators are fully redundant, and the hydraulic system designed such that redundant barrier element safety functions are controlled from separate hydraulic power supplies. This further ensures robustness and simplicity in the safety system design.

Embodiment 2: Segregated Accumulation for the Safety System

Figure 10:
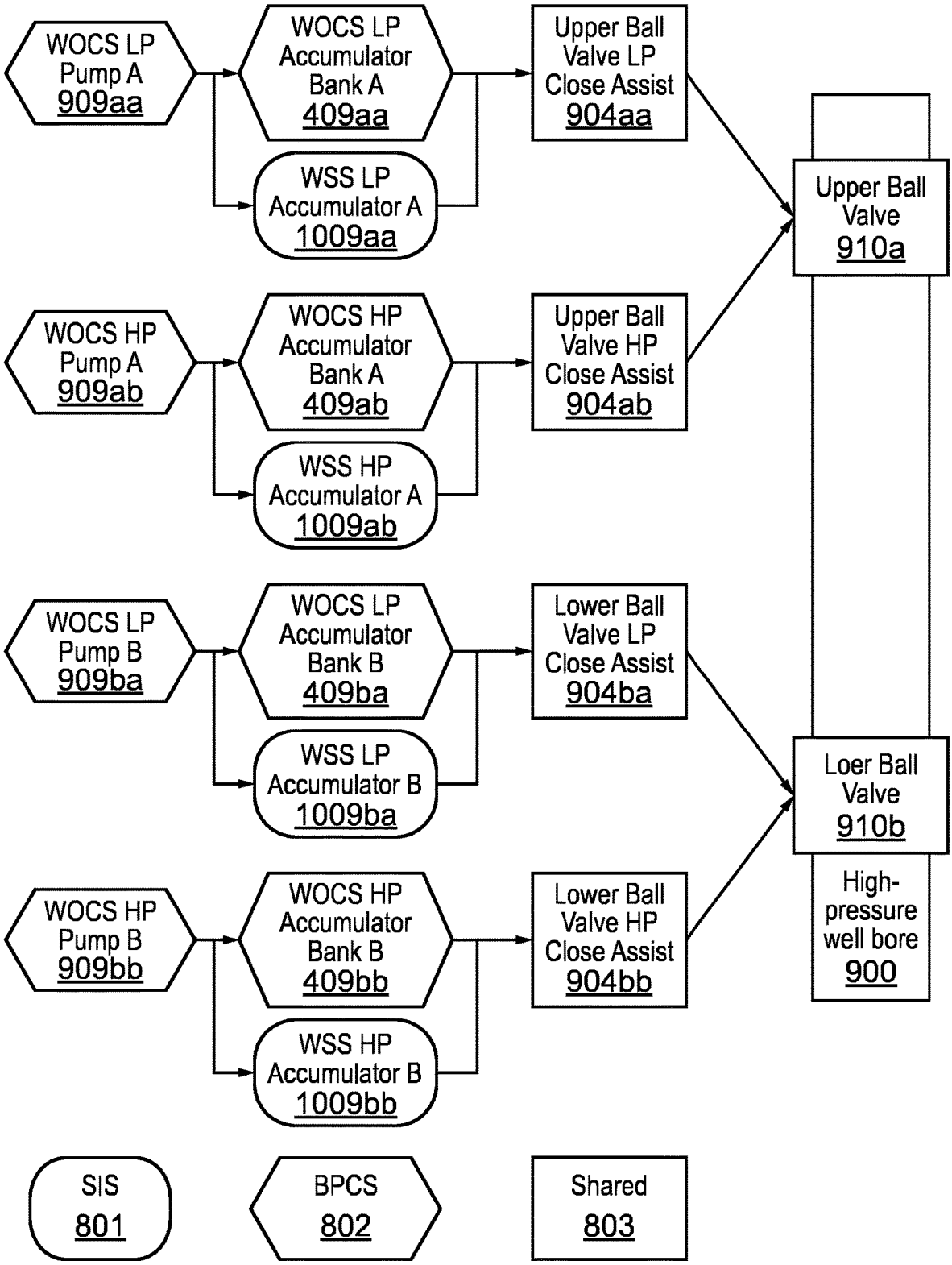
FIG. 10 illustrates an embodiment of the landing string ESD function using a second embodiment of the accumulator philosophy according to some of the example embodiments.

A simplified overview of the second embodiment is shown in FIG. 10. The Workover Safety System in this embodiment utilizes a separate set of accumulators 1009*aa*, 1009*ab*, 1009*ba*, and 1009*bb* charged by the WOCS pumps 909*aa*, 909*ab*, 909*ba*, and 909*bb* respectively. As in the first embodiment, the pumps are not part of the safety function to keep the safety system lean. The system ensures that there is enough accumulated capacity and power at all times sufficient to reach safe state. In specific events, such as an initiation of a safety function, the Workover Safety System accumulators 409*aa*, 409*ab*, 409*ba*, and 409*bb* are teed-in to the hydraulic function line to apply hydraulic power to the barrier elements upon said safety function initiation.

The first embodiment discussed above comprises example advantages such as reduced number of accumulators in the system, and the first embodiment being relatively simpler implementation over the second embodiment.

Now referring again to the recent regulatory requirements,

1. IEC 61511-1 11.2.11: For subsystems that on loss of power do not fail to the safe state, all of the following requirements shall be met and action taken according to 11.3
   a. Loss of circuit integrity is detected (for example, end-of-line monitoring);
   b. Power-supply integrity is ensured using supplemental power supply (for example, battery back-up, uninterruptible power supplies);
   c. Loss of power to the system is detected
2. IEC 61511-1 11.2.4: If it is intended not to qualify the basic process control system to this standard, then the basic process control system shall be designed to be separate and independent to the extent that the functional integrity of the safety instrumented system is not compromised.

NOTE 1 Operating information may be exchanged but should not compromise the functional safety of the Safety Instrumented System ("SIS").

NOTE 2 Devices of the SIS may also be used for functions of the basic process control system if it can be shown that a failure of the basic process control system does not compromise the safety instrumented functions of the safety instrumented system.

Item 1 here is interpreted as to require monitoring and surveillance of the power supply and the use of Uninterruptible Power Supply ("UPS"). For SIL2 requirement it is assumed redundant UPS is required and sufficient. The UPSs shall be monitored for preventive maintenance using the basic process control system ("BPCS") and for detection of loss of power supply using the Safety Instrumented System ("SIS").

Item 2 here is interpreted as to require the SIS to be segregated from the basic process control system to the extent possible, and that any and all shared elements and/or communications links cannot adversely affect the SIS.

The following realization is proposed to meet and surpass the safety regulations.

Now referring again to FIG. 7, the Workover Control System ("WOCS") is provided with two redundant UPSs, WOCS UPS A 402*a* and WOCS UPS B 402*b*. Both the UPSs are specified such that the BPCS can be kept live for a minimum of one hour upon loss of vessel/rig power supply. Due to requirements and margins for the calculations of the UPS specifications, such as capacity, the UPSs can normally maintain the BPCS live longer than the minimum requirement of one hour.

The WOCS UPSs 402*a* and 402*b* further ensure the ability of the WOCS Operator to manually take the system to its defined safe state. Depending upon the specific operating conditions, required steps to reach the safe state may vary.

Due to the overall rig/vessel philosophy the WOCS UPSs 402*a* and 402*b* are equipped with an electrically held switch 701*a* and 701*b*, Emergency Power Off ("EPO"), with which the vessel/rig ESD system may override the UPS setting and switch-off all power on the vessel/rig in the event of emergency. This in turn initiates an electrically held dump valve 705 (held directly by the WOCS UPSs 402*a* and 402*b* in a two-out-of-two ("2oo2") voting). The dump valve bleeds off the hydraulic pressure in the WOCS HPU, causing the BPCS to go to its defined safe state, i.e., well sealed and all functions de-energized.

For making the Workover Safety System aware of the initiation of the safe state defined in the WSS Emergency Shutdown ("ESD") and Process Shutdown SIFs, for example, caused by Vessel EPO signal or failure of both WOCS UPS A 402*a* and WOCS UPS B 402*b*, some of the example embodiments propose that the Workover Safety System should use the WOCS UPSs as back-up power supply. By doing this, the proposed system avoids instances such as when the WOCS has shut down, for example due to power loss, and the WSS does not know if system has reached safe state.

In the unlikely event that both WOCS UPSs should fail, it is a possibility for the WSS to include a third, independent UPS to maintain the ability to initiate Emergency Quick Disconnect ("EQD"). Please note that this third UPS too will be subject to the rig/vessel EPO signal, rendering the EQD function unavailable due to the global safety strategy. As in the previous section, the back-up initiators (acoustic, ROV and riser weak link) are still available because they do not rely on topside accumulated power (electric or hydraulic).

Figure 11:
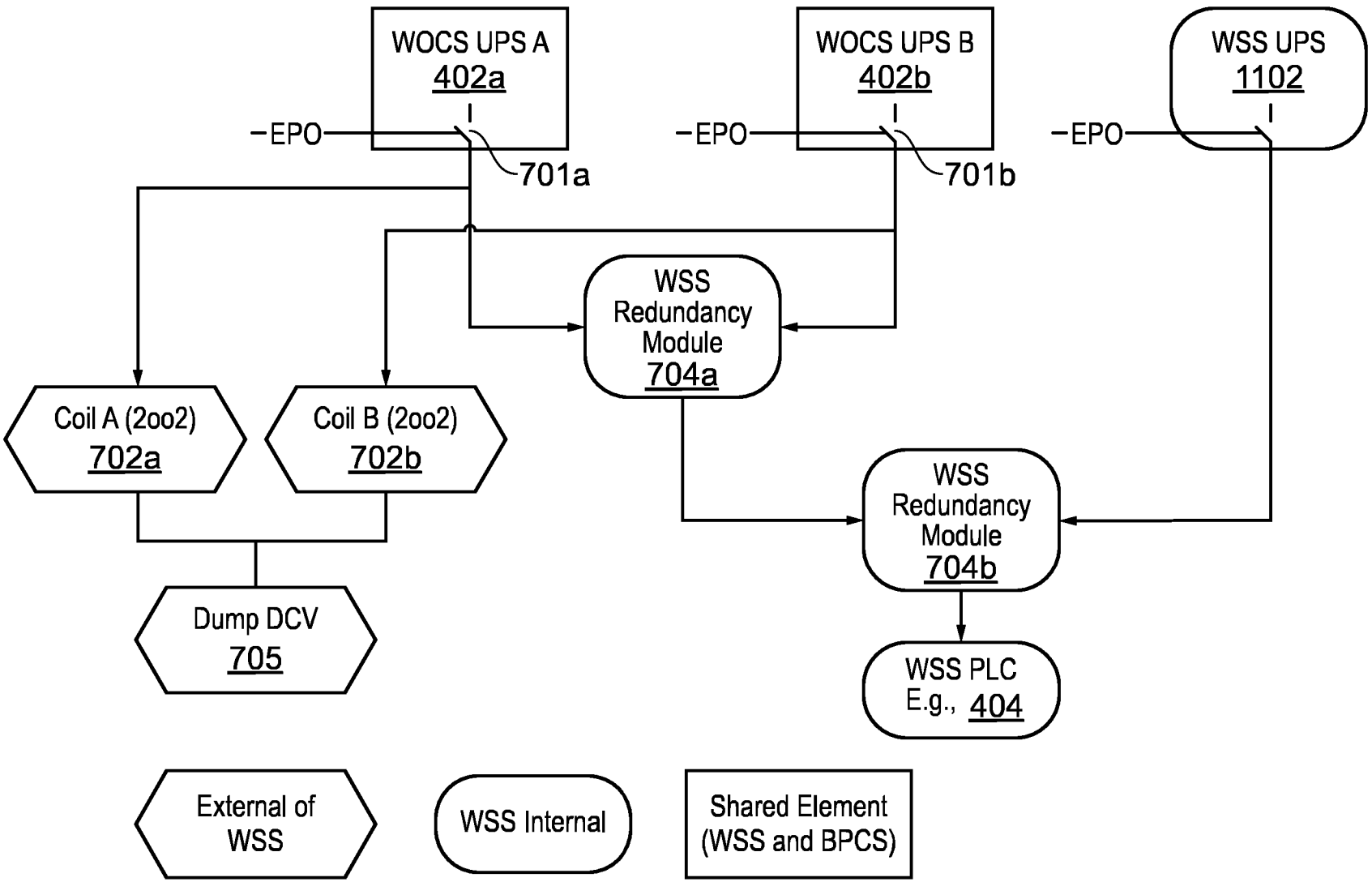
FIG. 11 illustrates an alternative embodiment of the UPS philosophy according to some of the example embodiments.

FIG. 11 shows another embodiment of the power management system according to some of the example embodiments. In this embodiment, the WSS 404 is supplied power in addition through a dedicated UPS 1102. The first redundancy module 704*a* provides redundancy between UPS A 402*a* and UPS B 402*b*. The second redundancy module 704*b* provides redundancy between the output from the first redundancy module and the dedicated WSS UPS 1102. In this embodiment the WSS can keep EQD available even after loss of WOCS UPSs 402*a,b*, but still has connection to WOCS UPSs 402*a,b* such that WSS is aware of loss of power to the WOCS and inherent fail-safe of the workover system.

Now referring again to one of the recent regulatory requirements,

1. IEC 61511-1 11.2.11: For subsystems that on loss of power do not fail to the safe state, all of the following requirements shall be met and action taken according to 11.3
   a. Loss of circuit integrity is detected (for example, end-of-line monitoring);
   b. Power-supply integrity is ensured using supplemental power supply (for example, battery back-up, uninterruptible power supplies);
   c. Loss of power to the system is detected Item 1 a here is interpreted as to require line monitoring of subsea lines and the high-voltage power supply unit ("HVPSU") output lines Item 1 c here is interpreted as to require monitoring and surveillance of the HVPSU condition, i.e. detection of internal failures.

Some of the example embodiments are directed towards making the Workover Safety System be simplified, robust and reliable. A key element recognized by the inventors for achieving this objective is to control subsea functions directly using hardwired electrical power.

The subsea functions typically require 4 W at 24 V DC to operate, and are configured to be electrically energized to activate. In other words, the safety functions require electrical power within a given range, for example, at a given voltage to reach safe state. Some requirements such as ISO 13628-7 for workover systems, are important to adhere to.

As an example, direct operation of the subsea DCV coils through cables in the umbilical with lengths of the order of 3600 m will encounter voltage drop over the length of the power carrying cable. The length of umbilical varies depending upon the depth of the actual field where the system is deployed. For supplying 24 VDC to a 4 W 24 VDC coil located subsea connected topside through a 3600 m long AWG 19 cable, a topside voltage of around 190 VDC is required. The voltage drop in the cable depends on several factors, including cable material, length, cross-section, resistivity, and even temperature, which typically alters the resistivity of the material.

The inventors propose the following method and system in yet another embodiment of some of the example embodiments, for improving the power supply conditions for the subsea components, including DCVs.

Figure 12:
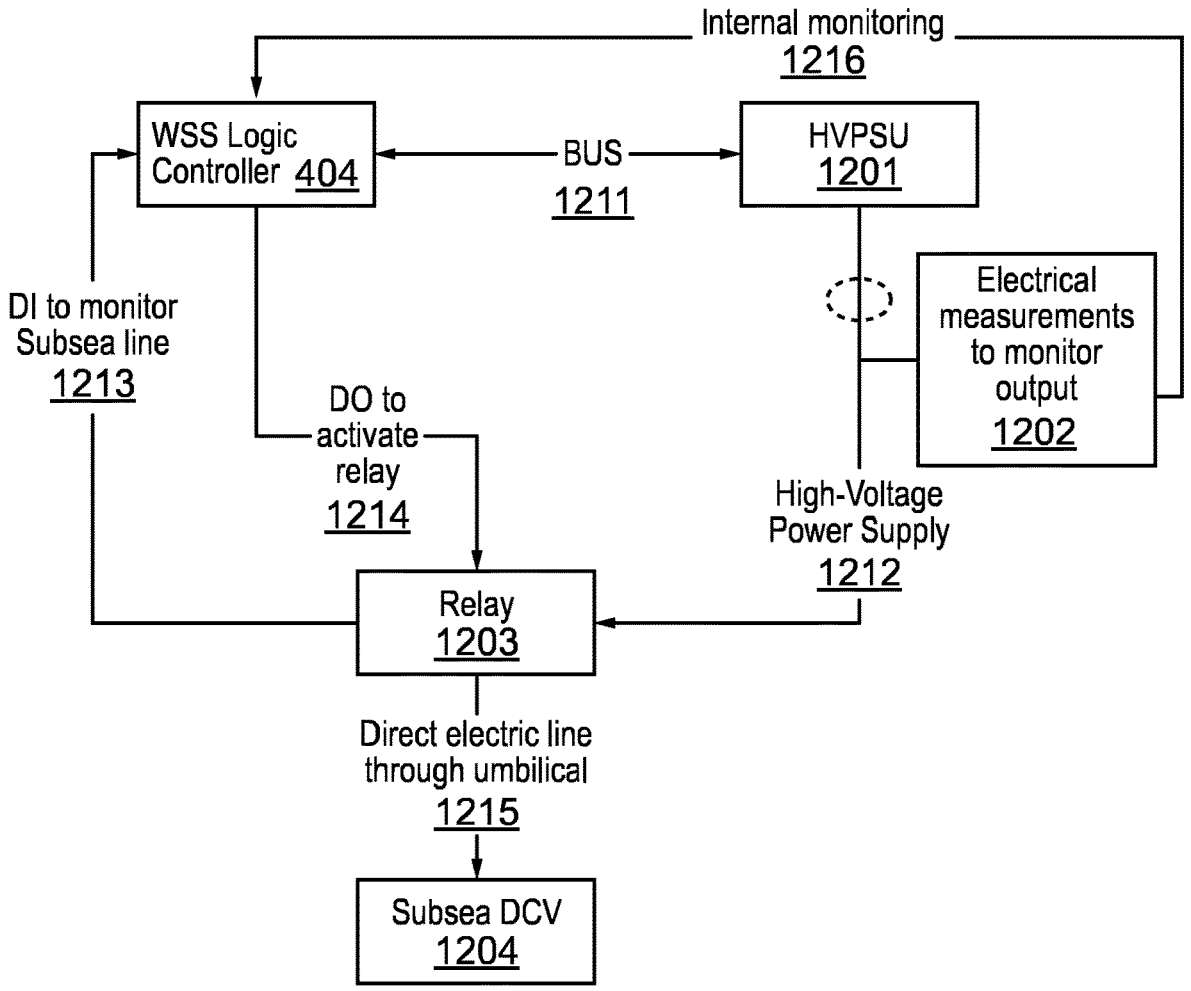
FIG. 12 illustrates an embodiment of the power management system according to some of the example embodiments.

Now referring to FIG. 12, a general form of system and method according to some of the example embodiments is proposed as follows, 1. Verify a theoretical model for calculating required topside power for energizing subsea components, such as solenoids, with variable cable lengths, cable cross-section, ambient temperature, and the number of components or solenoids connected in parallel on each cable.
2. Use the theoretical model to generate initial values for the power system settings and initialize the WSS Logic Controller 404, for example, a PLC with said settings.
3. Monitor the subsea line parameters, for example, using electrical measurement equipment 1202, and use said parameters, including voltage applied and current supplied in the subsea line to dynamically adjust the High Voltage Power Supply Unit ("HVPSU") 1201 settings. Said settings adjusted, for example, using a control interface or bus 1211 between the PLC 404 and the HVPSU 1201.
4. Use the measured parameters from the electrical measurement equipment 1202 to verify and correct the HVPSU 1201 settings, i.e., performing a comparison and correction between the commanded and actual settings.
5. Continuously monitor the HVPSU 1201 for internal diagnostics using the communications link, or bus 1211. Said communication link comprising, for example, a serial communication medium.
6. If a failure is detected in the HVPSU 1201, notify WOCS operator, for example, through SCADA HMI and SIL2 compatible WSS status lamps or displays accessible by the operator. Said lamps visible for the operator even when BPCS or SCADA HMI is not operational.

A person skilled in the art will understand that in practice there will be at least one HVPSU 1201 each for the A-branch, and for the B-branch for providing clean redundancy from the power supply to the final element in the system.

An important advantage of this embodiment is that the system may be built using off-the-shelf components to nevertheless achieve a highly reliable, robust and simplistic safety system. In other words, the High-Voltage Power Supply Units 1201 (HVPSU A and HVPSU B) can be selected as relatively inexpensive off-the-shelf components. This implies that they do not need to be pre-certified for use in SIL2 safety functions. The closed-loop monitoring and correction mechanism as proposed above results in a highly reliable safety system that can be developed using general purpose components, or without custom made components, thereby saving costs.

According to some of the example embodiments, the activation of specific final elements as referred in the above description will be discussed. To achieve the object of physical independency of the safety system as discussed above, following method and system of operating the final elements is proposed in example embodiments.

It is proposed that the WSS control be placed in series between the hydraulic source, for example, accumulators 402, and the final element, where said final elements is a Fail-Safe-Close ("FSC") final element. It is further proposed that the the WSS controlled be placed in parallel to the final element, where said final element is a Fail-As-Is ("FAI") element. By doing so WSS is made the dominant system for control of the final elements.

Figure 13:
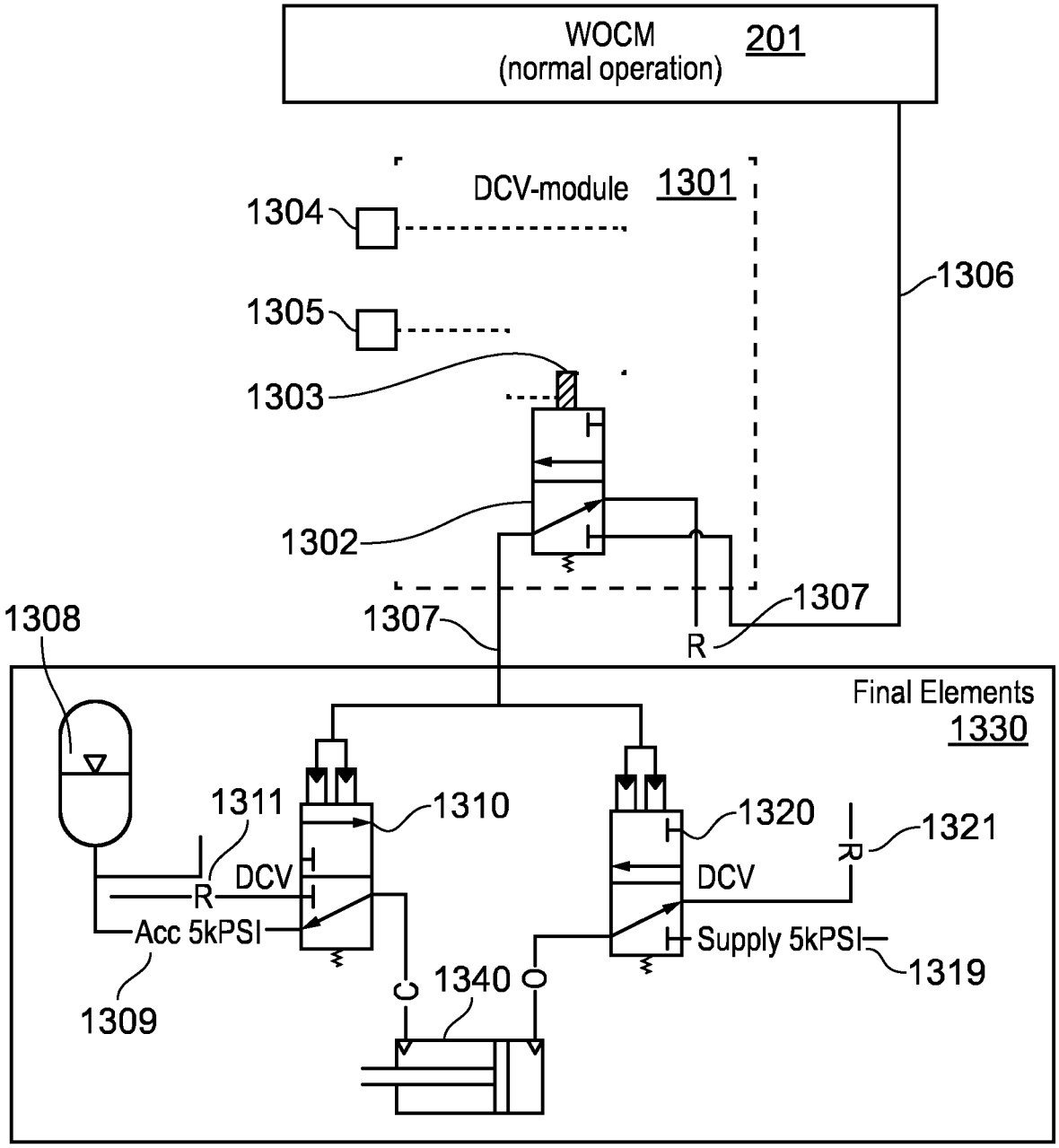
FIG. 13 illustrates an embodiment of the Fail-Safe-Close configuration according to some of the example embodiments.

FIG. 13 shows a simplified overview of a Fail-to-Safe or fail-safe-close configuration. Here WOCM 201 controls a DCV module 1301, both WOCM 201 and DCV module 1301 may be installed subsea. The DCV module 1301 comprises at least one DCV controlled by the WSS, said DCVs in the DCV modules may be electrically driven values such as solenoid valves, for example 1302. In this case, the solenoid valve 1302 is a WSS controlled DCV used for implementing the ESD and EQD functions. As shown, the solenoid valve 1302 is connected in series to the WOCM 201. In FIG. 13, the DCV 1302 operated by the WSS is shown activated, therefore WOCM 201 is not in control of the final elements 1330. When the WSS is activated, said DCV 1302 in the WSS will bleed off the hydraulic pressure in the line 1307, thus blocking off the control of the final elements 1330 from the WOCM 201. The final elements 1330 shown in FIG. 13 show a typical mainbore valve setup, for example, for RV, PIV and SH. Block 1330 shows an accumulator 1308 supplying hydraulic power to DCV 1310 through line 1309. The second DCV 1320 also receives a hydraulic supply through line 1319. The hydraulic supply to the valves 1310 and 1320 can either be supplied by the same accumulator or separate ones. The DCVs 1310 and 1320 are controlling the valve 1340 by routing the hydraulic supplies in lines 1310 and 1319 through ports C and O of the valve 1340.

Note that even though FIG. 13 shows a fail-safe-close configuration, the WSS fails-as-is, i.e., if e.g. the DCV module 1301 fails, the final element 1330 will not change state. This design is selected according to some of the example embodiments to avoid spurious trips of the safety functions, as spurious trips is equally dangerous to not achieving a trip on demand. Note that the DCV valve 1302 is illustrated activated in FIG. 13.

Figure 14:
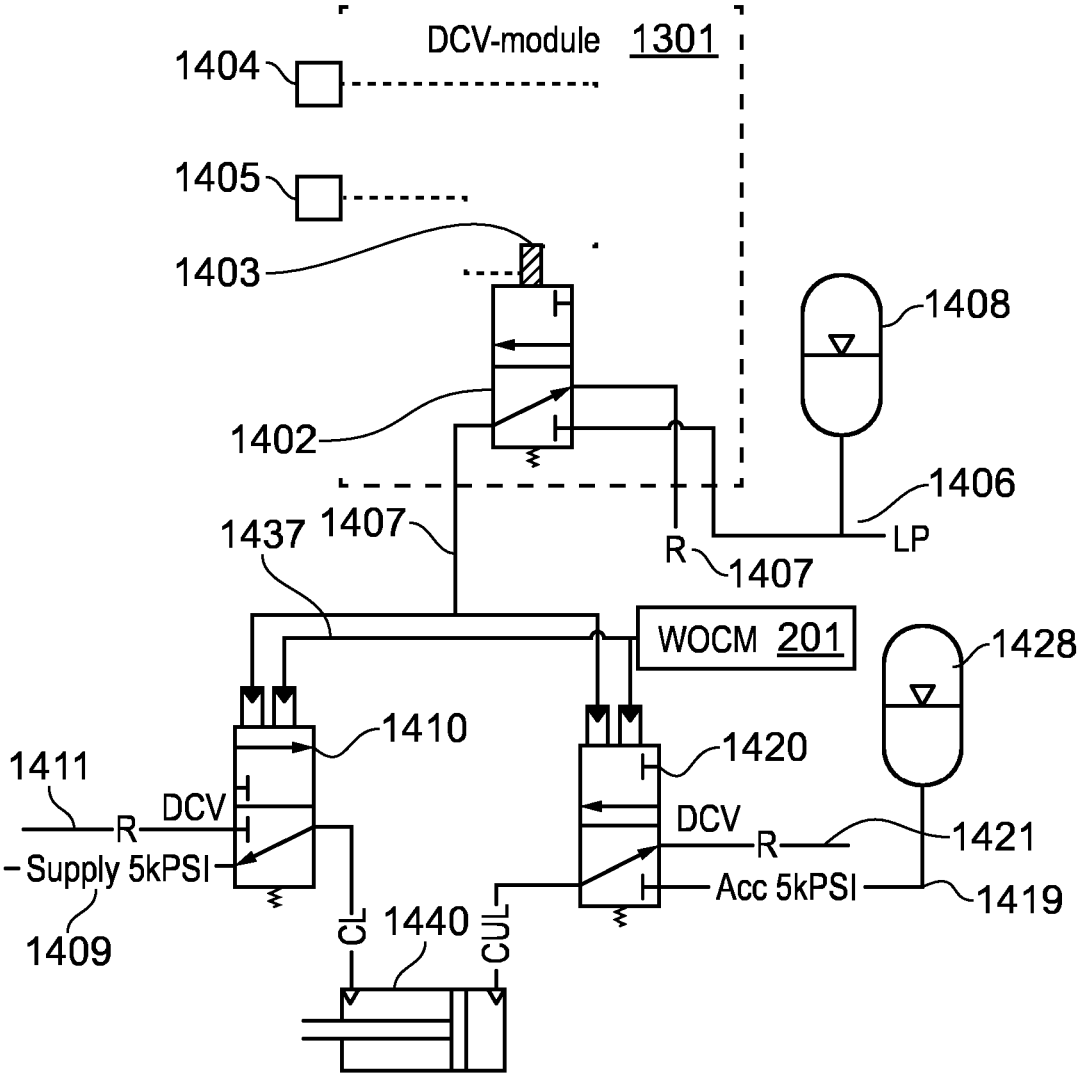
FIG. 14 illustrates an embodiment of the Fail-as-Is configuration for the activation of the final elements according to some of the example embodiments.

FIG. 14 shows a simplified overview of a Fail-as-IS configuration. The DCV module 1301 is similar to as discussed in FIG. 13, and is controlled by the WSS. As shown, the WSS uses a solenoid valve 1402 to interface with the inner pilot 1407 of the DCVs 1410 and 1420. The WOCM 201 interfaces with the outer pilot 1437 of the DCVs 1410 and 1420. When a safety sequence, for example, WSS EQD is activated, the pressure from the WSS, supplied through line 1406 by an accumulator 1408 is applied which leads the DCVs 1410 and 1420 to unlock the connector by applying hydraulic supplies through ports CUL and CL of the valve 1440.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the example embodiments are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The example embodiments are not restricted to the details of any foregoing embodiments. The example embodiments extend to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

That claimed is:

1. A workover safety system configured to override a workover control module arranged to actuate a component of an apparatus for a hydrocarbon-comprising well, the apparatus comprising a lower riser package and an emergency disconnect package;

the workover control module configured to regulate hydraulic fluid to the component, the workover control module comprising:

a hydraulic input configured to receive the hydraulic fluid from a corresponding hydraulic fluid source and a hydraulic output configured to deliver the received hydraulic fluid to the component, the workover safety system comprising:

a trigger input configured to receive a trigger signal, and at least one override valve in a series connection between at least one of:

the hydraulic input of the workover control module and the corresponding hydraulic fluid source of the workover control module, and the hydraulic output of the workover control module and the component, the safety system configured to close, particularly close a functional line and open a vent line, the at least one override valve upon receipt of the trigger signal to prevent the hydraulic fluid being delivered to the component.

2. The workover safety system of claim 1, wherein the workover safety system is separated from the workover control module with respect to software and hardware.

3. The workover safety system of claim 1, further comprising:

a safety accumulator configured to store and provide hydraulic fluid, and at least one pressure valve configured to receive the stored hydraulic fluid from the safety accumulator and deliver the stored hydraulic fluid to the component, wherein upon receipt of the trigger signal, the at least one pressure valve is configured to open to provide the stored hydraulic fluid from the safety accumulator to the component, particularly to at least one of a disconnect valve disposed in a well control package and an annular bag valve disposed in a BOP.

4. The workover safety system of claim 1, wherein the at least one override valve comprises a first override valve configured to be disposed in a series connection between a first corresponding hydraulic fluid source and a first corresponding hydraulic input, a second override valve in series connection between a second corresponding hydraulic fluid source and a second corresponding hydraulic input, and a least a third override valve in series connection between the hydraulic output of the workover control module and the component.

5. The workover safety system of claim 1, wherein the at least one override valve is configured to be disposed in a series connection between a topside control module valve and a pilot valve coupled to a surface production wing valve, wherein upon receipt of the trigger signal, the at least one override valve is configured to be in a closed position thereby preventing a flow of hydraulic fluid to the pilot valve and the surface production wing valve.

6. The workover safety system of claim 1, wherein valves in the workover safety system comprise replicate valves comprising an A/B redundancy.

7. The workover safety system of claim 1, wherein the trigger signal comprises an analog voltage, particularly, a Direct Current, DC, particularly up to 48V, including up to 25V.

8. An apparatus comprising:

the workover safety system of claim 1, and the workover control module.

9. The workover safety system of claim 1, further comprising:

a power management system comprising:

a trigger input;

a logic device comprising a processor, memory, and instructions stored in the memory and executable by the processor, the logic device coupled to the trigger input, the logic device configured to be coupled to:

an umbilical including a power line, particularly an umbilical having a length greater than 300 meters, particularly greater than 1000 meters; and at least one valve connected to the power line, particularly at least one of an override valve and an accumulator valve;

a power supply coupled to the logic device, particularly a DC power supply, particularly configured to deliver at least 30 volts, particularly up to about 500 volts, particularly a discrete power supply or a power supply integrated with the logic, the power supply configured to actuate the valve via the power line when connected to the valve; and a switch, particularly a relay, coupled to the logic device and power supply, the switch operable by the logic device to switch between:

a monitoring condition, in which the power supply is not connected to the valve, and an override condition, in which the power supply is connected to the valve;

the logic device configured to perform a method comprising:

measuring a parameter characterizing an electrical circuit including the power line and valve;

calculating a topside voltage expected to result in a desired voltage at the valve when delivered via the umbilical, the desired voltage sufficient to actuate the valve; and transmitting the calculated topside voltage to the power supply.

10. A workover safety system configured for use with a workover control module, and configured to actuate a component of an apparatus for a hydrocarbon-comprising well, particularly an apparatus comprising a lower riser package and an emergency disconnect package;

the workover control module configured to regulate hydraulic fluid to the component, the workover control module comprising:

a hydraulic input configured to receive the hydraulic fluid from a corresponding hydraulic fluid source and at least one hydraulic output configured to deliver the received hydraulic fluid to the component, the workover safety system comprising:

a safety accumulator configured to store and provide hydraulic fluid, a trigger input configured to receive a trigger signal, and at least one pressure valve configured to receive the stored hydraulic fluid from the safety accumulator and deliver the stored hydraulic fluid to the component;

the safety system configured to open the at least one pressure valve upon receipt of the trigger signal to deliver the stored hydraulic fluid from the safety accumulator to the component.

11. The workover safety system of claim 10, wherein the workover safety system is separated from the workover control module with respect to software and hardware.

12. The workover safety system of claim 10, further comprising at least one override valve in a series connection between at least one of:

the hydraulic input of the workover control module and the corresponding hydraulic fluid source of the workover control module, and a hydraulic output of the workover control module and the component, wherein the safety system is configured to close, particularly close a functional line and open a vent line, the at least one override valve upon receipt of the trigger signal to prevent the hydraulic fluid received from the hydraulic fluid sources from being delivered to the component.

13. The workover safety system of claim 12, wherein the at least one override valve comprises a first override valve in series connection between a first corresponding hydraulic fluid source and a first corresponding hydraulic input, a second override valve in series connection between a second corresponding hydraulic fluid source and a second corresponding hydraulic input, and a least a third override valve in series connection between the hydraulic output of the workover control module and the component.

14. The workover safety system of claim 12, wherein the at least one override valve is in a series connection between a topside control module valve a pilot valve coupled to a surface production wing valve, wherein upon receipt of the trigger signal, the at least one override valve is configured to be in a closed position thereby preventing a flow of hydraulic fluid to the pilot valve and the surface production wing valve.

15. The workover safety system of claim 10, wherein valves in the workover safety system comprise replicate valves having an A/B redundancy.

16. The workover safety system of claim 10, wherein the trigger signal comprises an analog voltage, particularly, a Direct Current, DC, particularly up to 48V, including up to 25V.

17. An apparatus comprising:

the workover safety system of claim 10, and the workover control module.

18. The workover safety system of claim 10, further comprising:

a power management system comprising:

a trigger input;

a logic device comprising a processor, memory, and instructions stored in the memory and executable by the processor, the logic device coupled to the trigger input, the logic device configured to be coupled to:

an umbilical including a power line, particularly an umbilical having a length greater than 300 meters, particularly greater than 1000 meters; and at least one valve connected to the power line, particularly at least one of an override valve and an accumulator valve;

a power supply coupled to the logic device, particularly a DC power supply, particularly configured to deliver at least 30 volts, particularly up to about 500 volts, particularly a discrete power supply or a power supply integrated with the logic, the power supply configured to actuate the valve via the power line when connected to the valve; and a switch, particularly a relay, coupled to the logic device and power supply, the switch operable by the logic device to switch between:

a monitoring condition, in which the power supply is not connected to the valve, and an override condition, in which the power supply is connected to the valve;

the logic device configured to perform a method comprising:

measuring a parameter characterizing an electrical circuit including the power line and valve;

calculating a topside voltage expected to result in a desired voltage at the valve when delivered via the umbilical, the desired voltage sufficient to actuate the valve; and transmitting the calculated topside voltage to the power supply.

19. A workover safety system configured to be coupled to a hydrocarbon processing arrangement to bring at least a part of the arrangement to a safe state, the arrangement comprising a control module, particularly at least one of a Workover Control Module ("WOCM"), a Subsea Electronics Module ("SEM"), Subsea Control Module ("SCM") and a Riser Control Module ("RCM"), the control module configured to actuate a component of the arrangement, particularly a component comprising at least one of a topside production facility, a Lower Riser Package ("LRP"), an Emergency Disconnect Package ("EDP"), a Blowout Preventer ("BOP"), a Riser Package ("RP"), a Drilling Package ("DP"), a Master Control Unit ("MCU"), and a Hydraulic Power Unit ("HPU"), a Christmas tree, particularly a surface tree, particularly a subsea tree, particularly a Christmas tree having an electrically actuated valve, a manifold, a coiled tubing frame, and a wireline frame, the control module comprising:

an energy input, particularly at least one of an electrical input, pneumatic input, and a hydraulic input, the energy input configured to receive a power flow from a corresponding power source sufficient to actuate the component, particularly an electric actuator, particularly at least one of a screw drive and a solenoid, particularly a hydraulic actuator, particularly to a pneumatic actuator; and an energy output, particularly at least one of a hydraulic output, pneumatic output, and an electrical output, configured to deliver the power flow, regulated via the control module, to the component;

the safety system comprising:

a control input configured to receive a trigger signal; and at least one override gate, particularly at least one of a valve and a switch, particularly a relay, in a series connection between at least one of:

the energy input of the control module and the corresponding power source; and the energy output of the control module and the component;

the safety system configured to close the at least one override gate upon receipt of the trigger signal to prevent the power flow from being delivered to the component.

20. The workover safety system of claim 19, wherein the workover safety system is separated from the control module with respect to software and hardware.

21. The workover safety system of claim 19, wherein the at least one override gate comprises a first override gate in series connection with a first corresponding power source, a second override gate in series connection with a second corresponding power source, and a least a third override gate in series connection between the energy output of the workover control module and the component.

22. The workover safety system of claim 19, further comprising at least one topside override gate in a series connection with a pilot gate and a surface production wing gate, particularly a surface production wing valve, wherein upon receipt of the trigger signal, the at least one topside override gate is configured to be in a closed position thereby preventing a power flow from being provided to the pilot gate and the surface production wing gate.

23. The workover safety system of claim 19, wherein gates in the workover safety system comprise replicate gates in an A/B redundancy.

24. The workover safety system of claim 19, wherein the trigger signal comprises an analog voltage, particularly, a Direct Current, DC, particularly up to 48V, including up to 25V.

25. The safety system of claim 19, further comprising the control module coupled to the safety system.

26. A safety system configured to be coupled to a hydrocarbon processing arrangement to bring at least a part of the arrangement to a safe state, the arrangement comprising a control module, particularly at least one of a Workover Control Module ("WOCM"), a Subsea Electronics Module ("SEM"), Subsea Control Module ("SCM") and a Riser Control Module ("RCM"), the control module configured to actuate a component of the arrangement, particularly a component comprising at least one of a topside production facility, a Lower Riser Package ("LRP"), an Emergency Disconnect Package ("EDP"), a Blowout Preventer ("BOP"), a Riser Package ("RP"), a Drilling Package ("DP"), a Master Control Unit ("MCU"), and a Hydraulic Power Unit ("HPU"), a Christmas tree, particularly a surface tree, particularly a subsea tree, particularly a Christmas tree having an electrically actuated valve, a manifold, a coiled tubing frame, and a wireline frame, the control module comprising:

an energy input, particularly at least one of an electrical input, pneumatic input, and a hydraulic input, the energy input configured to receive a power flow from a corresponding power source sufficient to actuate the component, particularly an electric actuator, particularly at least one of a screw drive and a solenoid, particularly a hydraulic actuator, particularly to a pneumatic actuator; and an energy output, particularly at least one of a hydraulic output, pneumatic output, and an electrical output, configured to deliver the power flow, regulated via the control module, to the component;

the safety system comprising:

a control input configured to receive a trigger signal; and at least one override gate, particularly at least one of a valve and a switch, particularly a relay, in a series connection between at least one of:

the energy input of the control module and the corresponding power source; and the energy output of the control module and the component;

the safety system configured to close the at least one override gate upon receipt of the trigger signal to prevent the power flow from being delivered to the component, and the safety system further comprising at least one pressure gate in a parallel connection with an energy output configured to provide a pressure to at least one gate, in particular a valve or relay, of the component, the at least one pressure gate configured to receive a power flow from at least one other power source, wherein upon receipt of the trigger signal, the at least one pressure gate is configured to be in an open position and provide said power flow to the at least one gate disposed in an Emergency Disconnect Package ("EDP"), a valve in a Riser Control Module ("RCM"), and/or an annular bag disposed within a Blowout Preventer ("BOP"), to provide a hydraulic pressure, independently of the control module, to the EDP and/or BOP, respectively.

27. A workover safety system configured to be coupled to a hydrocarbon processing arrangement to bring at least a part of the arrangement to a safe state, the arrangement comprising a control module, particularly at least one of a Workover Control Module ("WOCM"), a Subsea Electronics Module ("SEM"), Subsea Control Module ("SCM") and an Riser Control Module ("RCM"), the control module configured to actuate a component of the arrangement, particularly a component comprising at least one of a topside production facility, a Lower Riser Package ("LRP"), an Emergency Disconnect Package ("EDP"), a Blowout Preventer ("BOP"), a Riser Package ("RP"), a Drilling Package ("DP"), a Master Control Unit ("MCU"), and a Hydraulic Power Unit ("HPU"), a Christmas tree, particularly a surface tree, particularly a subsea tree, particularly a Christmas tree having an electrically actuated valve, a manifold, a coiled tubing frame, and a wireline frame the control module comprising:

an energy input, particularly at least one of an electrical input, a pneumatic input, and a hydraulic input, the energy input configured to receive a power flow from a corresponding power source sufficient to actuate the component, particularly an electric actuator, particularly at least one of a screw drive and a solenoid, particularly a hydraulic actuator, a pneumatic actuator; and an energy output, particularly at least one of a hydraulic output and an electrical output, configured to deliver the power flow, regulated via the control module, to the component;

the safety system comprising:

a control input configured to receive a trigger signal;

a safety accumulator, particularly at least one of a hydraulic accumulator, a battery, a capacitor, a flywheel, and a UPS, configured to store energy, and at least one accumulator gate, particularly at least one of a valve and a relay, configured to be disposed in a parallel connection with at least one of:

the energy input of the control module and the corresponding power source; and the energy output of the control module and the component;

the safety system configured to open the at least one accumulator gate upon receipt of the trigger signal to deliver the stored energy to the component.

28. The workover safety system of claim 27, wherein the workover safety system is separated from the workover control module with respect to software and hardware.

29. The workover safety system of claim 27, further comprising at least one override gate in a series connection between at least one of:

the energy input and the corresponding energy source of the control module, and an energy output of the control module and the component, wherein the safety system configured to close the at least one override gate upon receipt of the trigger signal to prevent the power flow being delivered to the component.

30. The workover safety system of claim 29, wherein the at least one override gate comprises a first override gate in series connection with a first corresponding power source, a second override gate in series connection with a second corresponding power source, and a least a third override gate in series connection between the energy output of the workover control module and the component.

31. The workover safety system of claim 27, further comprising at least one topside override gate in a series connection with a pilot gate and a surface production wing gate, particularly a surface production wing valve, wherein upon receipt of the trigger signal, the at least one topside override gate is configured to be in a closed position thereby preventing a power flow from being provided to the pilot gate and the surface production wing gate.

32. The workover safety system of claim 27, wherein gate in the safety system comprise replicate gates in an A/B redundancy.

33. The workover safety system of claim 27, wherein the trigger signal comprises an analog voltage, particularly, a Direct Current, DC, particularly up to 48V, including up to 25V.

34. The workover safety system of claim 27, further comprising:

a power management system comprising:

a trigger input;

a logic device comprising a processor, memory, and instructions stored in the memory and executable by the processor, the logic device coupled to the trigger input, the logic device configured to be coupled to:

an umbilical including a power line, particularly an umbilical having a length greater than 300 meters, particularly greater than 1000 meters; and at least one valve connected to the power line, particularly at least one of an override valve and an accumulator valve;

a power supply coupled to the logic device, particularly a DC power supply, particularly configured to deliver at least 30 volts, particularly up to about 500 volts, particularly a discrete power supply or a power supply integrated with the logic, the power supply configured to actuate the valve via the power line when connected to the valve; and a switch, particularly a relay, coupled to the logic device and power supply, the switch operable by the logic device to switch between:

a monitoring condition, in which the power supply is not connected to the valve, and an override condition, in which the power supply is connected to the valve;

the logic device configured to perform a method comprising:

measuring a parameter characterizing an electrical circuit including the power line and valve;

calculating a topside voltage expected to result in a desired voltage at the valve when delivered via the umbilical, the desired voltage sufficient to actuate the valve; and transmitting the calculated topside voltage to the power supply.

35. The workover safety system of claim 27, further comprising the control module coupled to the safety system.

* * * * *